US007478486B2

(12) United States Patent
Wunderlin et al.

(10) Patent No.: US 7,478,486 B2
(45) Date of Patent: Jan. 20, 2009

(54) SYSTEM AND METHOD FOR CONTROLLING A DRYER APPLIANCE

(75) Inventors: William Joseph Wunderlin, Louisville, KY (US); Michel Dion, Montréal (CA); Alexander Carswell Cambon, Louisville, KY (US); Mahmoud Fariz Ismail, Coral Springs, FL (US); Zubair Hameed, Louisville, KY (US); Cathy Diane Emery, Louisville, KY (US)

(73) Assignee: General Electric Company, Schenectady, NY (US)

( * ) Notice: Subject to any disclaimer, the term of this patent is extended or adjusted under 35 U.S.C. 154(b) by 169 days.

(21) Appl. No.: 11/337,123

(22) Filed: Jan. 20, 2006

(65) Prior Publication Data

US 2006/0191161 A1 Aug. 31, 2006

Related U.S. Application Data

(62) Division of application No. 10/831,727, filed on Apr. 23, 2004, now Pat. No. 7,013,578, which is a division of application No. 09/563,022, filed on May 2, 2000, now Pat. No. 6,845,290.

(51) Int. Cl.
*F26B 3/00* (2006.01)

(52) U.S. Cl. ..... 34/491; 34/261; 34/528

(58) Field of Classification Search ..... 34/491, 34/499, 262, 261, 318, 528, 595, 606, 486, 34/495, 445, 305

See application file for complete search history.

(56) References Cited

U.S. PATENT DOCUMENTS 4,112,767 A 9/1978 Bochan (Continued)

OTHER PUBLICATIONS

William S. Cleveland; *The Elements of Graphing Data*; Wadsworth Advanced Books And Software; pp. 174-178; Copyright 1985.

(Continued)

*Primary Examiner*—Kenneth B Rhinehart
(74) *Attorney, Agent, or Firm*—George L. Rideout, Esq.; Armstrong Teasdale LLP

(57) ABSTRACT

System and method for controlling an appliance for drying clothing articles is provided. The appliance has a container for receiving the clothing articles. A motor is provided for rotating the container about an axis. A heater is provided for supplying heated air to the container during a dry cycle. A sensor is provided for providing a signal indicative of moisture content of the articles. Memory is provided memory for storing historical stop time data of respective dry cycles. A noise-reduction filter is coupled to receive the signal from the moisture sensor to provide selectable filtering to that signal. A timer provides a signal indicative of elapsed time upon start of the dry cycle. A module is responsive to the historical data in the memory for determining an initial estimate of the stop time of the dry cycle to be executed. A processor allows for estimating the stop time of the dry cycle as the cycle is being executed. The estimation of the stop time is based on a respective functional relationship of the noise-reduced sensor signal, and the timer signal, relative to one or more characteristics of the articles and one or more desired values of predetermined dry-cycle parameters selectable by a respective user of the dryer. The initial estimate of the stop time is superceded by the stop time estimated by the processor as the cycle is being executed.

28 Claims, 18 Drawing Sheets

U.S. PATENT DOCUMENTS

| | | | |
|---|---|---|---|
| 4,206,552 | A | 6/1980 | Pomerantz et al. |
| 4,213,250 | A | 7/1980 | Hawkins |
| 4,216,461 | A | 8/1980 | Werth et al. |
| 4,223,379 | A | 9/1980 | Simcoe |
| 4,224,530 | A | 9/1980 | Simcoe |
| 4,231,166 | A | 11/1980 | McMillan |
| 4,275,508 | A | 6/1981 | Jones |
| 4,286,391 | A | 9/1981 | Gerry |
| 4,318,084 | A | 3/1982 | Scott et al. |
| 4,372,054 | A | 2/1983 | Pomerantz et al. |
| 4,385,452 | A | 5/1983 | Deschaaf et al. |
| 4,397,101 | A | 8/1983 | Rickard |
| 4,422,247 | A | 12/1983 | Deschaaf |
| 4,447,965 | A | 5/1984 | Bray |
| 4,531,305 | A | 7/1985 | Nagayasu et al. |
| 4,586,267 | A | 5/1986 | Sussman |
| 4,713,894 | A | 12/1987 | Roth et al. |
| 4,733,479 | A | 3/1988 | Kaji et al. |
| 4,738,034 | A | 4/1988 | Muramatsu et al. |
| 4,763,425 | A | 8/1988 | Grennan |
| 4,788,775 | A | 12/1988 | Ahmed |
| 4,902,878 | A | 2/1990 | Smith et al. |
| 4,991,313 | A | 2/1991 | Joslin |
| 5,050,313 | A | 9/1991 | Wakaeya et al. |
| 5,097,606 | A | 3/1992 | Harmelink et al. |
| 5,131,169 | A | 7/1992 | Jaster |
| 5,193,292 | A | 3/1993 | Hart et al. |
| 5,285,545 | A | 2/1994 | Payne et al. |
| 5,291,667 | A | 3/1994 | Joslin et al. |
| 5,345,694 | A | 9/1994 | Hayashi |
| 5,347,727 | A | 9/1994 | Kim |
| 5,412,291 | A | 5/1995 | Payne et al. |
| 5,444,924 | A | 8/1995 | Joslin et al. |
| 5,444,996 | A | 8/1995 | Joslin et al. |
| 5,570,520 | A | 11/1996 | Huffington |
| 5,647,231 | A | 7/1997 | Payne et al. |
| 5,682,684 | A | 11/1997 | Wentzlaff et al. |
| 5,713,137 | A | 2/1998 | Fujita |
| 5,737,852 | A | 4/1998 | Shukla et al. |
| 5,782,012 | A | 7/1998 | Sanders et al. |
| 5,831,524 | A * | 11/1998 | Tice et al. ..... 340/506 |
| 5,899,005 | A | 5/1999 | Chen et al. |
| 6,020,698 | A | 2/2000 | Stenger et al. |
| 6,047,486 | A | 4/2000 | Reck et al. |
| 6,098,310 | A | 8/2000 | Chen et al. |
| 6,122,840 | A | 9/2000 | Chbat et al. |
| 6,141,887 | A | 11/2000 | Chen et al. |
| 6,199,300 | B1 | 3/2001 | Heater et al. |
| 6,313,646 | B1 | 11/2001 | Davis et al. |
| 6,446,357 | B2 | 9/2002 | Woerdehoff et al. |
| 6,519,871 | B2 | 2/2003 | Gardner et al. |
| 6,845,290 | B1 | 1/2005 | Wunderlin et al. |
| 2002/0184789 | A1 | 12/2002 | Gardner et al. |

OTHER PUBLICATIONS

Spyros Makridakis; Steven C. Wheelwright; Rob J. Hyndman; *Forecasting: Methods And Applications*, 3rd Addition; John W. Wiley & Sons, Inc.; pp. 158-161, 1998.

Frederick Mosteller; John W. Tukey; *Data Analysis and Regression: A Second Course in Statistics*; Addison-Wesley Publishing Company; pp. 52-71 and pp. 179-187.

Help Files-Minitab For Windows Software Package; Release 11.21; Copyright 1996 by Minitab, Inc., 1977.

* cited by examiner

Graph 1

Graph 2

Graph 3

Graph 4

SYSTEM AND METHOD FOR CONTROLLING A DRYER APPLIANCE

RELATED APPLICATIONS

This application is a divisional of, and claims the benefit of, U.S. Ser. No. 10/831,727, filed on Apr. 23, 2004 now U.S. Pat. No. 7,013,578, which is a divisional of U.S. Ser. No. 09/563,022 filed on May 2, 2000, now issued as U.S. Pat. No. 6,845,290, and are incorporated herein by reference in their entirety.

BACKGROUND OF THE INVENTION

The present invention is generally related to an appliance for drying articles, and, more particularly, the present invention is related to a dryer using microprocessor-based control for automatically shutting off the dryer.

It is known that the optimum drying time for clothes varies greatly as a function of the fabric type and size of the load. For example, it is generally desirable to dry at a relatively high temperature so as to minimize the drying time, but some fabric types are damaged by hot temperatures. Also, different types of fabrics have different water storage capacities and different water removal rates. Since the drying results provided by known dryer control techniques are believed to be somewhat unpredictable, there is a need for a clothes dryer that can statistically and probabilistically estimate the time when the articles will reach a desired moisture content or degree of dryness with a high degree of accuracy, regardless of the specific characteristics of the articles and various dry-cycle parameters selectable by the user. This ability would facilitate any further clothes processing, such as execution of a sanitize cycle for eliminating microorganisms after executing a dry cycle.

It would be further desirable to provide a dryer that is able to use noise-filtering techniques suited to reduce the noise level of a sensor signal indicative of the moisture content of the articles in order to further enhance the accuracy of dry-cycle time estimates. It would be also desirable to provide an initial estimate of the stop time of a dry cycle to be executed based on historical data collected from a previously executed cycle. Additionally, it would be desirable to provide consistent relationships for any such initial stop rime estimate to account for the specific characteristics of the articles and the dry-cycle parameters selectable by the user. Moreover, it would be desirable to automatically adjust any initial time estimate as the respective cycle is being executed based on algorithms or logic designed to account for the actual dry-cycle conditions. Another desirable feature in a dryer would be to display to the user information regarding the time remaining for executing any cycle being selected by the user, while avoiding jumps in the time display that could otherwise confuse the user if the dry cycle needs to be extended to accommodate the actual drying conditions.

SUMMARY OF THE INVENTION

Generally speaking, the present invention in one exemplary embodiment fulfills the foregoing needs by providing an appliance for drying clothing articles. The appliance has a container for receiving the clothing articles. A motor is provided for rotating the container about an axis. A heater is provided for supplying heated air to the container during a dry cycle. A sensor is provided for providing a signal indicative of moisture content of the articles. Memory is provided for storing historical stop time data of respective dry cycles. A noise-reduction filter is coupled to receive the signal from the moisture sensor to provide selectable filtering to that signal. A timer provides a signal indicative of elapsed time upon start of the dry cycle. A module is responsive to the historical data in the memory for determining an initial estimate of the stop time of the dry cycle to be executed. A processor allows for estimating the stop time of the dry cycle as the cycle is being executed. The estimation of the stop time is based on a respective functional relationship of the noise-reduced sensor signal, and the timer signal, relative to one or more characteristics of the articles and one or more desired values of predetermined dry-cycle parameters selectable by a respective user of the dryer. The initial estimate of the stop time is superceded by the stop time estimated by the processor as the cycle is being executed.

The present invention may further fulfill the foregoing needs by providing in another aspect thereof, a method for drying clothing articles in a dryer appliance. The method allows for generating a signal indicative of moisture content of the articles. The method further allows for storing historical stop time data of respective dry cycles and for executing selectable filtering to the sensor signal to generate a smoothed signal. A generating step allows for generating a signal indicative of elapsed time upon start of the dry cycle. A determining step allows for determining an initial estimate of the stop time of the dry cycle to be executed based on the historical stop time data. An estimating step allows for estimating the stop time of the dry cycle as the cycle is being executed. The estimation of the stop time based on a respective functional relationship of the noise-reduced signal, and the elapsed time signal, relative to one or more characteristics of the articles and one or more desired values of predetermined dry-cycle parameters selectable by a respective user of the dryer. The initial estimate of the stop time is superceded by the stop time estimated as the cycle is being executed.

DETAILED DESCRIPTION OF THE INVENTION

Figure 1:
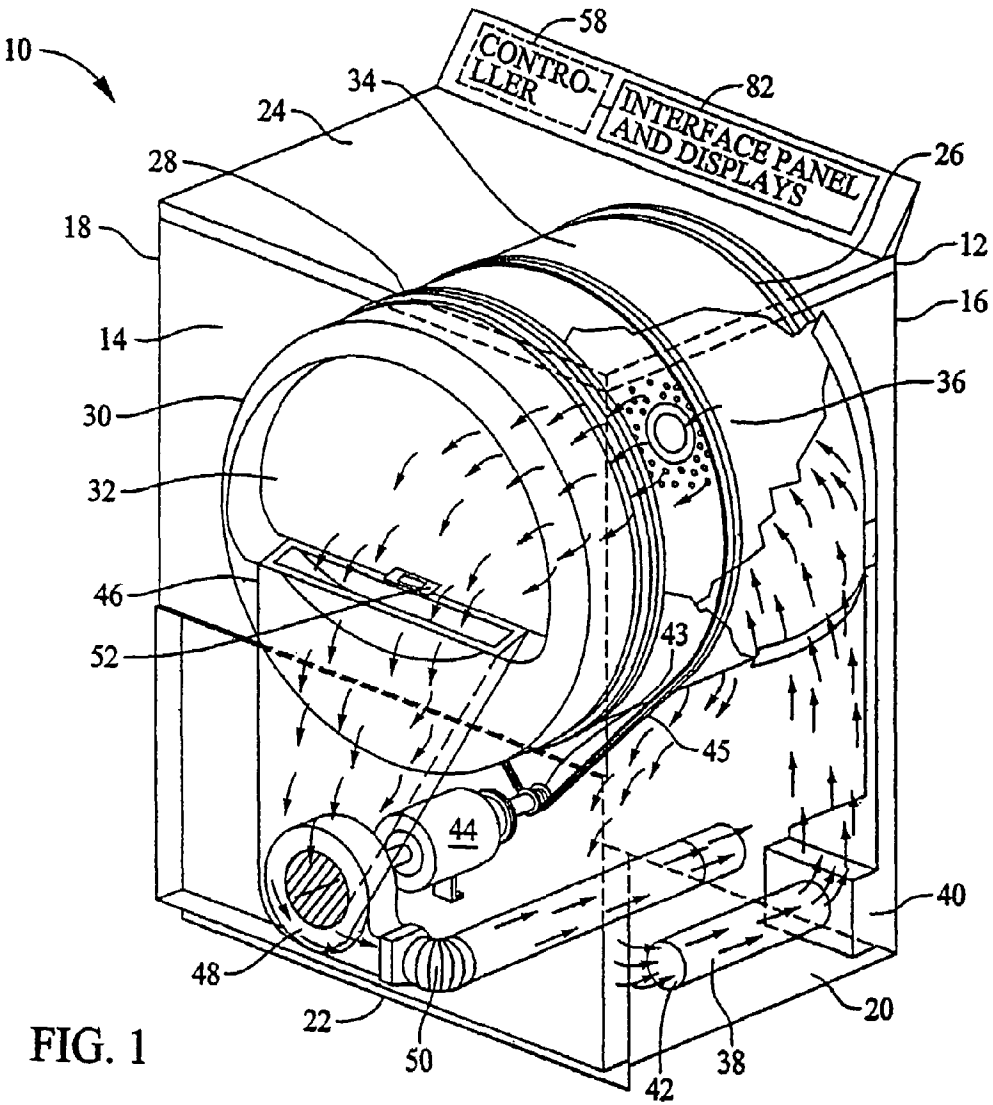
FIG. 1 shows a perspective view of an exemplary clothes dryer that may benefit from the present invention.

FIG. 1 shows a perspective view of an exemplary clothes dryer 10 that may benefit from the present invention. The clothes dryer includes a cabinet or a main housing 12 having a from panel 14, a rear panel 16, a pair of side panels 18 and 20 spaced apart from each other by the front and rear panels, a bottom panel 22, and a top cover 24. Within the housing 12 is a drum or container 26 mounted for rotation around a substantially horizontal axis. A motor 44 rotates the drum 26 about the horizontal axis through, for example, a pulley 43 and a belt 45. The drum 26 is generally cylindrical in shape, having an imperforate outer cylindrical wall 28 and a front flange or wall 30 defining an opening 32 to the drum. Clothing articles and other fabrics are loaded into the drum 26 through the opening 32. A plurality of tumbling ribs (not shown) are provided within the drum 26 to lift the articles and then allow them to tumble back to the bottom of the drum as the dram rotates. The drum 26 includes a rear wall 34 rotatably supported within the main housing 12 by a suitable fixed bearing. The rear wall 34 includes a plurality of holes 36 that receive hot air that has been heated by a heater such as a combustion chamber 38 and a rear duct 40. The combustion chamber 38 receives ambient air via an inlet 42. Although the exemplary clothes dryer 10 shown in FIG. 1 is a gas dryer, it could just as well be an electric dryer without the combustion chamber 38 and the rear duct 40. The heated air is drawn from the drum 26 by a blower fan 48 which is also driven by the motor 44. The air passes through a screen filter 46 which traps any lint particles. As the air passes through the screen filter 46, it enters a trap duct seal 48 and is passed out of the clothes dryer through an exhaust duct 50. After the clothing articles have been dried, they are removed from the drum 26 via the opening 32.

In one exemplary embodiment of this invention, a moisture sensor 52 is used to predict the percentage of moisture content or degree of dryness of the clothing articles in the container. Moisture sensor 52 typically comprises a pair of spaced-apart rods or electrodes and further comprises circuitry for providing a voltage signal representation of the moisture content of the articles to a controller 58 based on the electrical or ohmic resistance of the articles. By way of example and not of limitation, the sensor signal may be chosen to provide a continuous representation of the moisture content of the articles in a range suitable for processing by controller 58. It will be appreciated that the signal indicative of the moisture content need not be a voltage signal being that, for example, through the use of a voltage-controlled oscillator, the signal moisture indication could have been chosen as a signal having a frequency that varies proportional to the moisture content of the articles in lieu of a signal whose voltage level varies proportional to the moisture content of the articles.

As the clothes are tumbled in dryer drum 26 they randomly contact the spaced-apart electrodes of stationary moisture sensor 52. Hence, the clothes are intermittently in contact with the sensor electrodes. The duration of contact between the clothes and the sensor electrodes is dependent upon several factors, such as drum rotational speed, the type of clothes, and the amount or volume of clothes in the drum. When wet clothes are in the dryer drum and in contact with the sensor electrodes, the resistance across the sensor is low. Conversely, when the clothes are dry and contacting the sensor electrodes, the resistance across the sensor is high and indicative of a dry load. However, there may be situations that could result in erroneous indications of the actual level of dryness of the articles. For example, in a situation when wet clothes are not contacting the sensor electrodes, the resistance across the sensor is very high (open circuit), which would be falsely indicative of a dry load. Further, if a conductive portion of dry clothes, such as a metallic button or zipper, contacts the sensor electrodes, the resistance across the sensor would be low, which would be falsely indicative of a wet load. Hence, when the clothes are wet there may be times when the sensor will erroneously sense a dry condition (high resistance) and, when the clothes are dry, there may be times when the sensor will erroneously sense a wet condition (low resistance). The noise-reduction and smoothing provided by controller 58, to be described in greater detail hereafter, leads to a more accurate and reliable sensing of the actual dryness condition of the articles and this results in more accurate and reliable control of the dryer operation.

The controller 58 is responsive to the voltage signal from moisture sensor 52 and predicts a percentage of moisture content or degree of dryness of the clothing articles in the container as a function of the resistance of the articles. As suggested above, the value of the voltage signal supplied by moisture sensor 52 is related to the moisture content of the clothes. For example, at the beginning of the cycle when the clothes are wet, the voltage from moisture sensor may range between about one or two volts. As the clothes become dry, the voltage from moisture sensor 52 may increase to a maximum of about five volts, for example.

Figure 2:
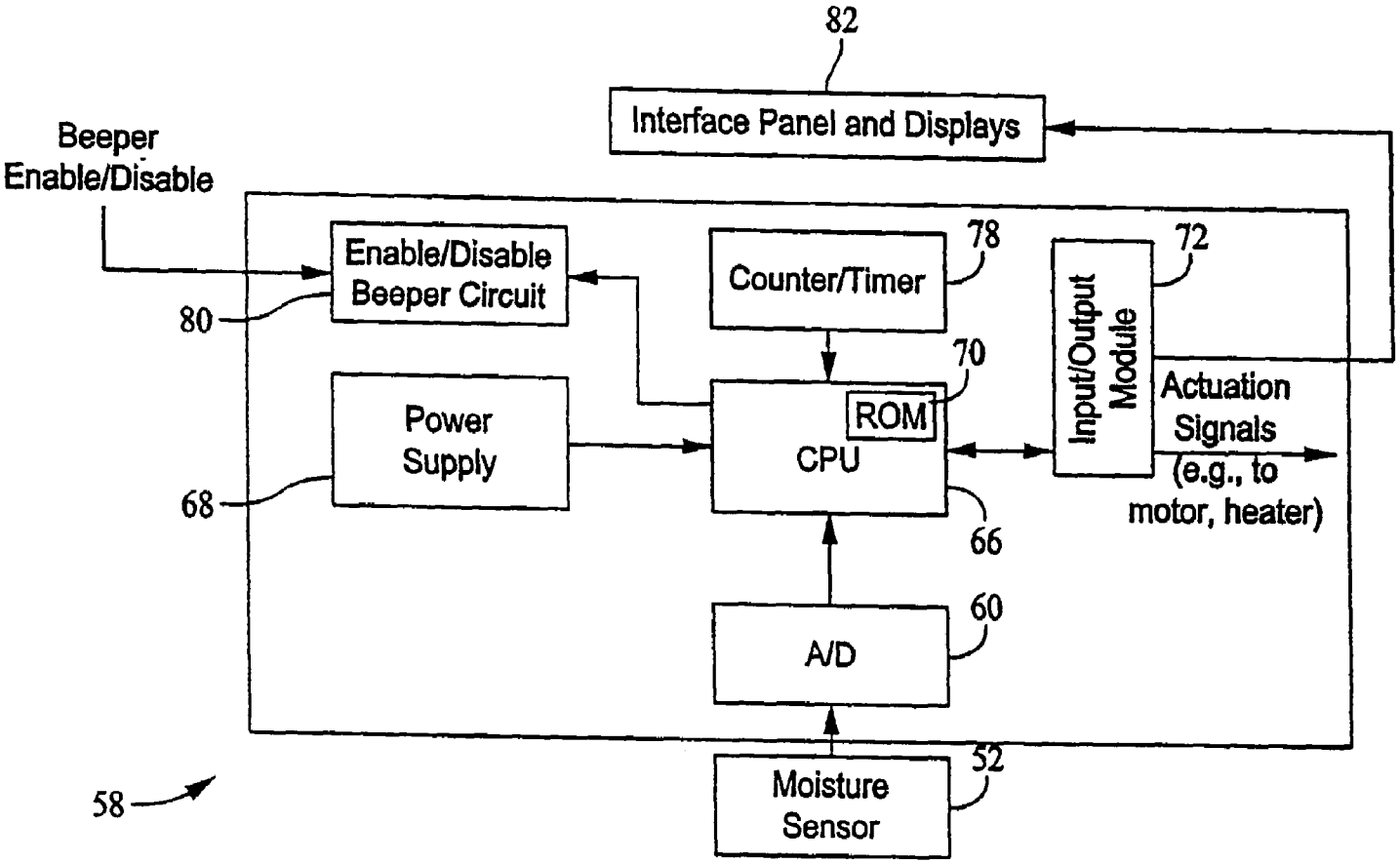
FIG. 2 shows a block diagram of a controller system used in the present invention.

A more detailed view of the controller used in the present invention is shown in FIG. 2. Controller 58 comprises an analog to digital (A/D) converter 60 for receiving the signal representations sent from moisture sensor 52. The signal representation from A/D converter 60 and a counter/timer 78 are sent to a central processing unit (CPU) 66 for further signal processing which is described below in more detail. The CPU which receives power from a power supply 68 comprises one or more processing modules stored in a suitable memory device, such as a read only memory (ROM) 70, for predicting a percentage of moisture content or degree of dryness of the clothing articles in the container as a function of the electrical resistance of the articles. It will be appreciated that the memory device need not be limited to ROM memory being that any memory device that permanently stores instructions and data will work equally effective. Once it has been determined that the clothing articles have reached a desired degree of dryness, then CPU 66 sends respective signals to an input/output module 72 which in turn sends respective signals to deenergize the motor and/or heater. As the drying cycle is shut off, the controller may activate a beeper via an enable/disable beeper circuit 80 to indicate the end of the cycle to an user. An electronic interface and display panel 82 allows the user for programming operation of the dryer and further allows for monitoring progress of respective cycles of operation of the dryer.

Figure 3:
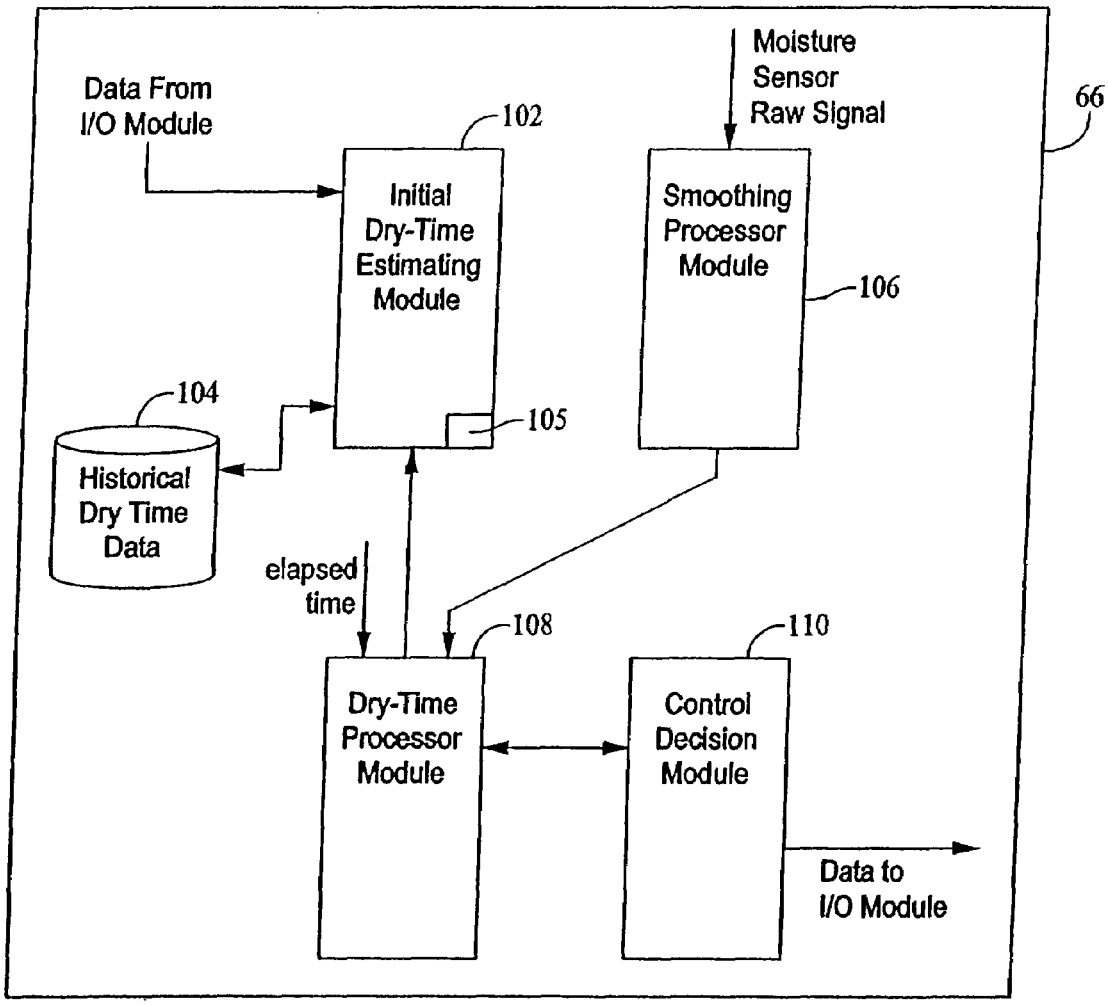
FIG. 3 illustrates further details regarding exemplary modules in the controller of FIG. 2.

FIG. 3 illustrates various exemplary processing modules used in CPU 66. In one exemplary embodiment of the present invention, the processing modules in CPU 66 may comprise respective software modules, such as may be stored in any suitable computer-readable medium, however, the present invention need not be limited to software modules being that the same operational interrelationships may be executed using hardware modules. An initial dry time estimating module 102 allows for estimating the dry time for a respective load at the beginning of the cycle using historical dry time data, such as may be stored in a memory unit 104. A noise-reduction or smoothing module 106 allows for filtering or smoothing the output voltage signal from moisture sensor 52 using a predetermined time weighted averaging technique to reduce the noise level in that voltage signal to obtain more accurate estimates of the moisture level content in the articles to be dried. A processor module 108 allows for probabilistically and statistically determining or estimating a stop time of a respective drying cycle corresponding to a target moisture level in the articles being dried. The estimation may be based on the value of the voltage signal from the moisture sensor and may be further based on the value of the elapsed time signal upon start of a respective dry cycle. A control decision module 110 allows for executing control decisions, such as execution of a sanitize cycle upon completion of a drying cycle.

Figure 4:
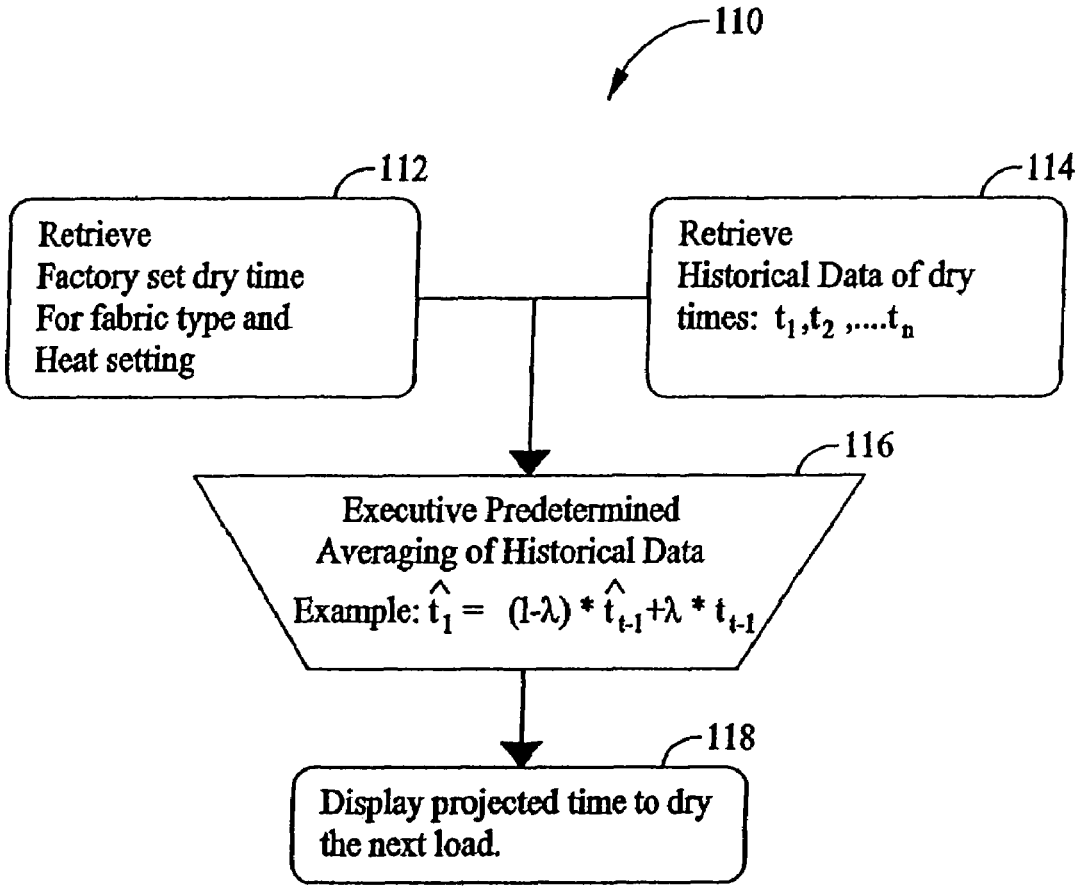
FIG. 4 is an exemplary flow chart that may be executed in a module for estimating an initial dry-cycle stop time.

FIG. 4 illustrates exemplary steps that may be executed in initial dry time estimating module 102. Module 102 uses respective parameter values selected by the consumer such as cycle selection, heat setting, etc., to determine an initial estimate of the dry time. For example, as shown in FIG. 4, step 112 allows for retrieving factory-set dry time, such as may correspond to a respective fabric type and heat setting. It will be appreciated that the factory-set dry time may assume typical operating conditions, such as initial moisture content, load size, exhaust vent condition, room temperature, room humidity, etc. Thus, each combination of respective cycles and heat settings would have its own initial estimated dry lime value. It will be recognized, however, that the typical operating conditions assumed for determining such initial dry time estimates may substantially vary depending on the specific consumer habits and/or dryer installation. For example, whether the user consistently uses heavy loads, as opposed to light loads, or whether the specific installation of the dryer venting is conducive to efficient elimination of moisture from the dryer. Step 114 allows for retrieving historical data of the dry times, such as the respective dry times of successive loads previously executed by that dryer. The historical data is then used to adjust the respective factory-set dry times for a future load to be executed based, for example, on the specific habits of a respective user and/or the installation characteristics of a given dryer. Thus, it will be appreciated that estimating module 102 allows for compensating noise parameters relative to the time required to achieve a target moisture content in the articles. By way of illustration and not of limitation, examples of such noise parameters may include ambient temperature, humidity, consumer habits, dryer venting differences, etc. Each of the foregoing parameters may influence the predicted initial dry time for a given load under nominal conditions, however, as suggested above, module 102 allows for compensating for such variations. Step 116 allows for executing predetermined averaging of the historical data stored in memory unit 104 (FIG. 3). In one exemplary embodiment, module 102 executes an exponentially weighted moving average for calculating or estimating the initial dry time. In this exemplary embodiment the estimated dry time for the next load is equal to:

$$(1-\lambda)*\text{previous dry time estimate}+(\lambda)*(\text{most recent dry time}),$$

wherein $\lambda$ is a predetermined time weighing or moving average constant.

It will be appreciated by those skilled in the art that an exponentially weighted moving average is only one example of a technique for processing the historical data for estimating the initial dry time, since other time averaging techniques could be used in lieu of an exponentially weighted moving average. A typical value for constant $\lambda$ is 0.2. The above-described technique ensures that random variations that may occur from one dry cycle to the next do not have a significant effect on the estimation of the initial dry time and that only statistically consistent usage and environmental influences would cause significant variation on the initial dry time estimation. Further, it will be appreciated that the above-described technique for processing the historical data requires relatively little storage being that such processing uses summary statistics in lieu of processing every single data point of each stop time of previously executed dry cycles. Step 118 allows for displaying the estimated initial dry time for the next load to be executed. In operation, the factory-set values for dry time may be used for the first run of the dryer. As an example, suppose that the initial estimate of the dry time is 30 minutes. However, a consumer may typically run large loads of articles and may have an inefficient venting system. If the dry time for several loads is greater than 30 minutes, then the dryer will use the historical data information to give or to adjust the 30 minutes factory-set initial dry time to a value greater than 30 minutes for future loads.

Thus, as described above, module 102 allows for executing in one exemplary embodiment an exponentially weighted moving average to refine the initial estimates of the respective times required to dry a load of clothes in a closed dryer. It will be appreciated, however, that it will be desirable to provide time estimates that maintain self-consistency of the respective initial estimates of the dry times for distinct operational conditions of the dryer. The distinct operational conditions may include respective combinations of the target moisture content in the articles, such as damp, less dry, dry, more dry, etc., and the respective heat settings for executing a respective drying cycle, such as high, medium, low, and gentle.

As will be appreciated by those skilled in the art, if the above-described exponentially weighted moving average technique is used independently of the respective combination of moisture target and heat setting for any given dry cycle, then some apparent inconsistencies in the initial estimated time could occur. For example, the initial time estimate for "less dry" could be longer than the time estimated for "more dry." Conversely, the initial time estimated for "high heat" could be longer than the time estimated for "low heat." Thus, module 102 preferably includes a processing sub-module 105 (FIG. 3) for ensuring that appropriate relationships arc maintained for each respective combination of the target moisture and the heat setting, while providing accurate initial estimates of the dry time. The processing provided by sub-module 105 enables to maintain consistency in a table like the following:

TABLE 1

| | Damp | Less dry | Dry | More dry |
|---|---|---|---|---|
| High heat | $t_{21}$ | $t_{12}$ | $t_{13}$ | $t_{14}$ |
| Medium heat | $t_{21}$ | $t_{22}$ | $t_{23}$ | $t_{24}$ |
| Low heat | $t_{31}$ | $t_{32}$ | $t_{33}$ | $t_{34}$ |
| Gentle heat | $t_{41}$ | $t_{42}$ | $t_{43}$ | $t_{44}$ |

Where each $t_{ij}$ represents a respective cell or entry of the initial estimated dry time for the ith heat level and the jth dryness target. It will be appreciated that the following relationships should hold:

$$t_{i1} \leqq t_{i2} \leqq t_{i3} \leqq t_{i4}, \text{ for each i}$$

$$t_{1j} \leqq t_{2j} \leqq t_{3j} \leqq t_{4j}, \text{ for each j}$$

One of the above-listed cells may be referred to as a "key" or a "reference" cell. This may be the cell that is expected to be used most frequently, or could correspond to the cell that it is actually used most frequently by a specific user. By way of example, suppose that cell $t_{13}$ (high heat; dry) is the key cell. A ratio ($r_{ij}$) will be calculated for each cell, $r_{ij}=t_{ij}/t_{13}$.

In one exemplary embodiment, the key cell may be updated after each respective execution of a dry cycle at the ith heat level and jth target dryness level with an exponentially weighted moving average based on the following equation:

$$(\text{new } t_{13})=(\text{previous } t_{13})*[(1-\lambda)*\text{previous } r_{ij})+\lambda*(\text{last run time})]/(\text{previous } t_{ij})$$

and all other cells are to be updated based on the following equation:

$$t_{ij}=r_{ij}*t_{13}.$$

Figure 5:
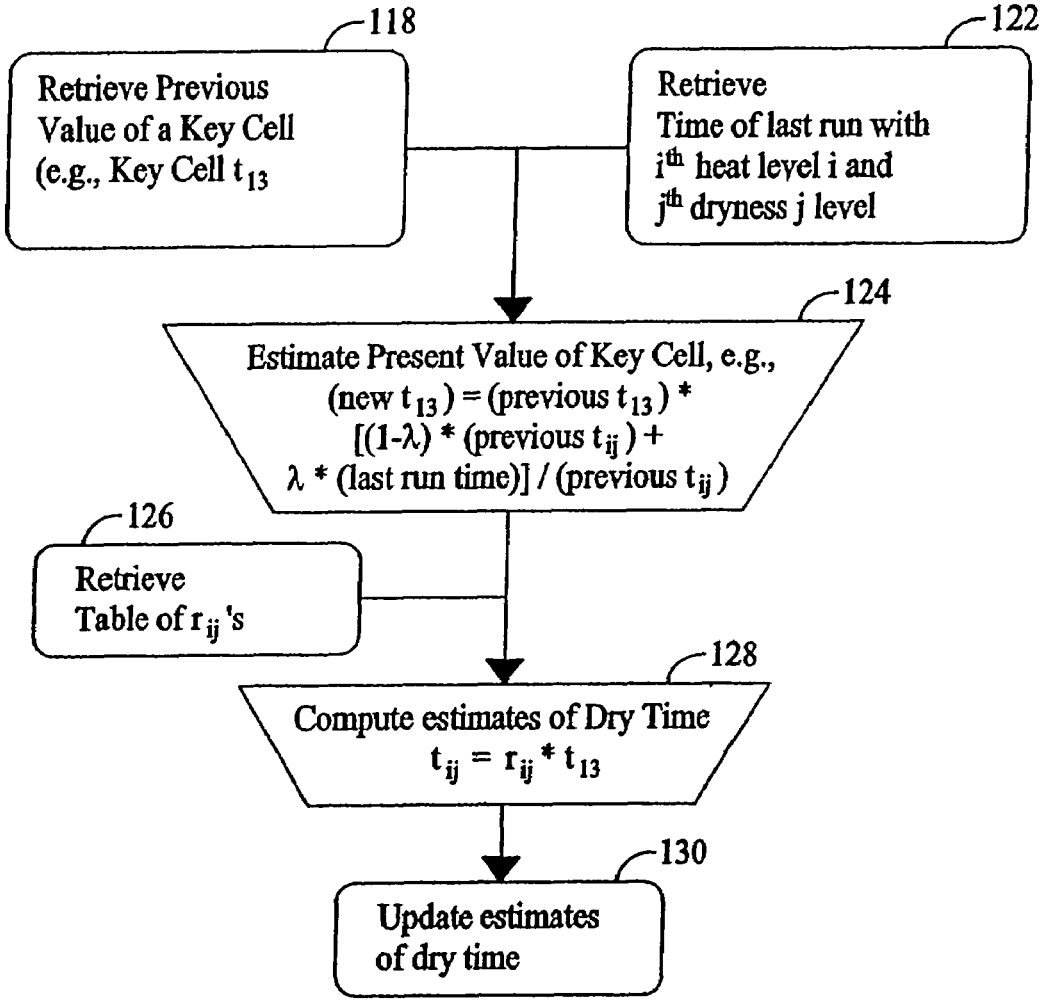
FIG. 5 is an exemplary flow chart for maintaining consistent relationships in respective estimates for the initial stop time.

FIG. 5 illustrates exemplary steps that may be executed in processing submodule 105 for maintaining consistent relationships between initial estimates of dry times regardless of the specific moisture and heat setting combination chosen by a respective user. Step 120 allows for retrieving a previous value of a key cell, example key cell $t_{13}$. Step 122 allows for retrieving the actual dry time of the last run for a given ith level of heat and a given jth level of target dryness. Step 124 allows for estimating the present value of the key cell, which as suggested above may be executed using a predetermined exponentially weighted moving average algorithm. Step 126 allows for retrieving a table of ratios $r_{ij}$ for each cell. Assuming, the key cell for example corresponds to cell $t_{13}$, step 128 allows for computing estimates of dry time based on the following equation:

$$t_{ij}=r_{ij}*t_{13}.$$

Step 130 allows for updating the initial estimates of dry time which are based both on statistically consistent influencing conditions, as opposed to random variations, and is further consistent with the respective operational conditions of the dryer, such as target moisture and heat setting selected by the user for a given dry cycle.

As suggested above, once a dry cycle is in progress, the voltage signals from the moisture sensor can be used to estimate the moisture content of the articles being dried based on the actual characteristics of the load being dried as opposed to an initial estimate based on historical data. Thus, the voltage signal from the moisture sensor can be used as an input to processor module 108 (FIG. 3) to statistically and probabilistically determine when the clothes are dry near or at a target level of moisture content, and the drying cycle should terminate. It will be appreciated that the voltage signal from the moisture sensor may be highly variable over time. As suggested above, the articles may from time to time contact the electrodes of the moisture sensor and sometimes would not come in contact at all with the electrodes of the moisture sensor due to the generally random tumbling pattern of the clothes. Other factors, such as the type of fabric of the load, load weight, etc., would also affect how fast or slow the level of the voltage signal changes as a function of time.

As suggested above, the output signal from moisture sensor 52 may start at a level of about one or two volts at the beginning of the drying cycle when the clothes are wet, and by the end of the cycle may have reached a voltage level of about five volts when the clothes are dry. However, the voltage signal may include noise and will vary to different voltage levels for short periods of time as the drying cycle is being executed.

In view of the noisiness of the voltage signal from the moisture sensor, the noise-reduction or smoothing module 106 (FIG. 3) receives the voltage signal from moisture sensor 52 to execute noise reduction or smoothing of such signal from the moisture sensor. In one exemplary embodiment, smoothing module 106 uses historical values and the overall pattern or trend of the voltage signal, rather than the most recent value.

It will be appreciated that control techniques that do not include noise reduction or smoothing could be vulnerable to erroneous control decisions. For example, an erroneous control decision could result in stopping the dryer too soon, that is, prematurely stopping the dryer without achieving the target moisture content selected by the user. Thus, in view of their vulnerability to noise, such techniques could incorrectly react as soon as a target voltage is reached due to a noise spike, and as a result the clothes may not be dried to the desired target dryness when the dryer stops. Conversely, techniques that use analog filtering may fail to provide a true representation of the signal indicative of the moisture content of the articles being dried and could stop the dryer too late, resulting in over-drying of the clothes, waste of energy and possibly permanent damage to the clothes.

In one exemplary embodiment of the present invention, module 106 uses a Holt's linear method, also referred in the art as a double exponential weighted moving average, for executing die noise reduction. As will be appreciated by those skilled in the art, the Holt's linear method is a very different noise-reduction technique as compared to a single exponential weighted moving average because the Holt's linear method allows for processing a respective slope term to accurately track for level changes in the signal being filtered. For readers interested in gaining further background regarding smoothing filtering techniques a useful reference may be found on pages 158 through 161 of textbook titled, *Forecasting: Methods and Applications*, by Makridakis, Wheelwright, Hyndman, 3rd Edition, published by John Wiley & Sons Inc., 1998, which textbook is herein incorporated by reference. Those skilled in the art will appreciate that an extension of a moving average technique is forecasting by weighted moving average. With plain moving average forecasts, the mean of the past k observations may be used as a forecast. This implies equal weights (equal to 1/k) for all k data points. However, with forecasting, the most recent observations will usually provide the best guide as to the future, so it may be desirable to provide a weighting scheme that has decreasing weights as the observations get older.

By way of example, there may be smoothing techniques that use exponentially decreasing weights as the observations get older. Thus, such techniques are generally referred to as exponential smoothing techniques. It will be appreciated that there are various exponential smoothing techniques. Each of such techniques, however, have in common the property that recent values are given relatively more weight in forecasting than the older observations. One way to modify the influence of past data on the forecast is to specify at the outset just how many past observations will be included in a mean. The term "moving average" is commonly used to describe such procedure because as each new observation becomes available, a new average can be computed by dropping the oldest observation and including the newest one. This moving average will then be the forecast for the next period.

An exemplary noise-reduction or smoothing algorithm is as follows:

$$L_t=\alpha Y_t+(1-\alpha)(L_t+b_{t-1})$$

$$b_t=\beta(L_t-L_{t-1})+1-\beta)b_{t-1}$$

Where:

$L_t$ is an estimate of the level of the series at time t $B_t$ is an estimate of the slope of the series at the time t $\alpha$ and $\beta$ are smoothing constants $Y_t$ is the observed level of the series at the time t It is believed that the above-listed exemplary algorithm exhibits at least the following advantages:

It is relatively straightforward and fast to compute, which is advantageous for inexpensive microprocessors where computational power may be at a premium for making real time calculations an control decisions.

It requires relatively little storage of past calculated values, which is desirable in an inexpensive processing system.

It accounts for changes in the slope of the raw signal over time, in addition to changes in amplitude.

It gives relatively quick response to changes in signal level, as opposed to standard single exponential smoothing, which tends to lag the true signal response when there are changes in the signal level.

It would not be highly influenced by extreme deviations that could have occurred due to noise peaks.

It can be used with relatively small values of smoothing parameters alpha and beta. This means that the algorithm may use a relatively long history of the raw signal and would not overreact to changes in the signal that have a relatively short duration. It will be appreciated that the values of smoothing parameters alpha and beta are generally chosen to be about 0.2 for most smoothing applications. In the present application, even smaller values may be implemented since data collection is executed fairly rapidly (e.g., one Hz) and since the raw signal from the moisture sensor may be substantially noisy.

It will be appreciated that the values of the smoothing parameters alpha and beta may range from zero to one. If the smoothing parameters are close to zero, then the smoothed samples will be slower to track changes in the raw signal. Conversely, if the smoothing parameters alpha and beta are close to one, then the smoothed samples will respond quicker to changes in the raw signal. By way of example, the initial value of the slope ($b_1$) can be set to zero at the beginning of the cycle, and the initial value of the level ($L_1$) can be set equal to the first value in the series ($Y_1$).

Figure 6:
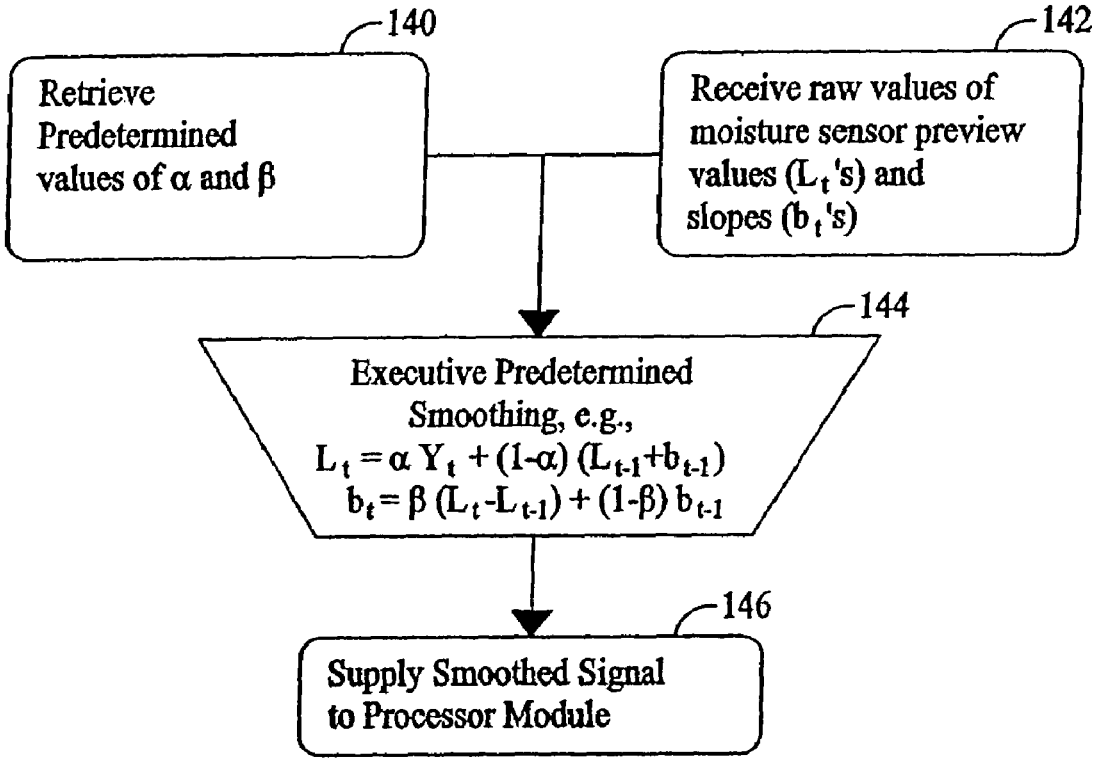
FIG. 6 is an exemplary flow chart for executing noise-reduction in a signal from a moisture sensor.

FIG. 6 illustrates exemplary steps that may be executed in smoothing processor module 106 (FIG. 3). Step 140 allows for retrieving predetermined values of smoothing parameters alpha and beta. Step 142 allows for receiving raw values or samples of the moisture sensor signal, previous values of estimates of the level of the series at time ($L_t$) and previous estimates of the slope ($B_t$) of the series. Step 144 allows for executing predetermined smoothing of the samples of the raw signal supplied by the moisture sensor. Step 146 allows for supplying a smoothed signal to processor module 108 (FIG. 3). By way of example, the voltage signal from the moisture sensor may be recorded every second during the dryer cycle. The smoothing algorithm allows for generating a new series substantially free of noise, such as may be executed by the double exponential algorithm used to translate the raw voltage measurement ($Y_t$) into smoothed measurements ($L_t$). The smoothed measurements are then used in subsequent calculations in processor module 108 to determine the appropriate time to stop the dryer.

It will be appreciated that the smoothing technique used in module 106 need not be limited to double exponential smoothing being that other smoothing techniques may be implemented in smoothing processing module 106. Some of these smoothing techniques may include:

adaptive single exponential smoothing with larger smoothing parameter alpha if the series increasing and smaller alpha if the series is decreasing median polish LOWESS (locally weighted sum of squares)

resistant smoothing spline fits

For readers desiring even further background information in connection with smoothing techniques, reference is made to textbook titled "*Data Analysis and Regression*" by Mosteller and Tukey, and more specifically at pp. 52 for running medians, pp. 61 for smoothing non-linear regression, pp. 180 for median polish, pp. 182 for mean polish techniques. The above-referred textbook was copyrighted in 1977 and published by Addison-Wesley Publishing Company. See also textbook titled "*The Elements of Graphing Data*" by William Cleveland, at pp. 174-178 for further background information regarding LOWESS smoothing techniques, copyrighted in 1995 and published by Wadsworth Advanced Book Program, A Division of Wadsworth, Inc. Further, commercially available statistical software packages, such as Minitab software may be used by the designer for gaining insight in connection with various smoothing processing techniques.

Figure 7:
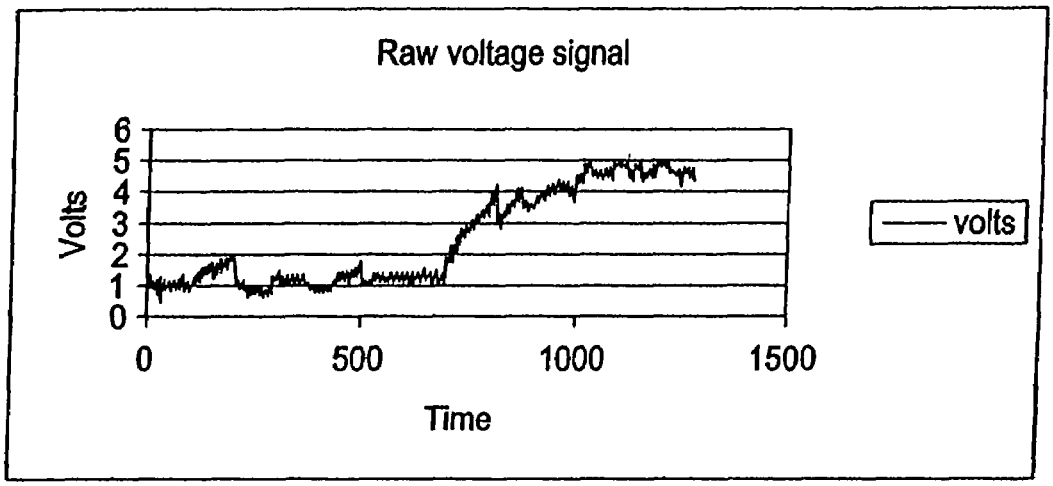
FIGS. 7 through 12 show respective plots of exemplary noise-reduced signals.
Figure 8:
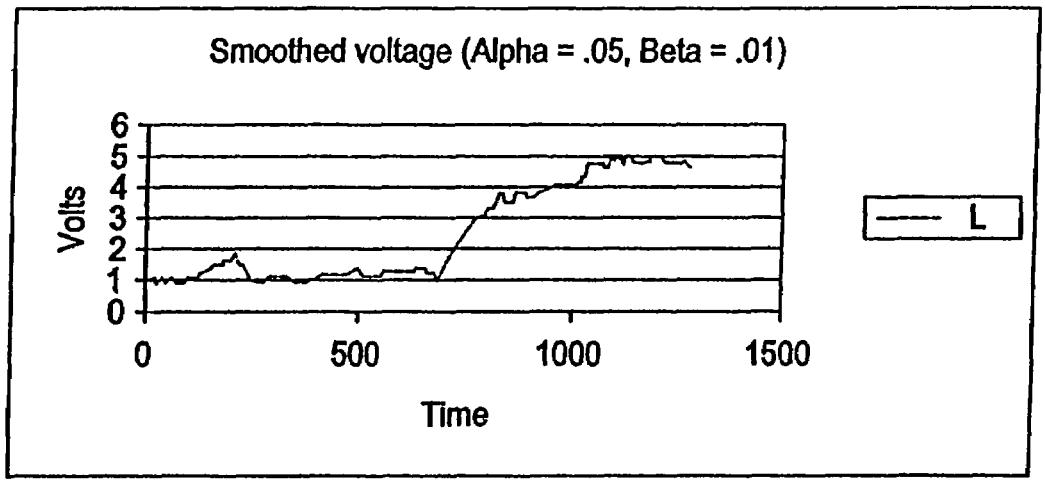
Figure 9:
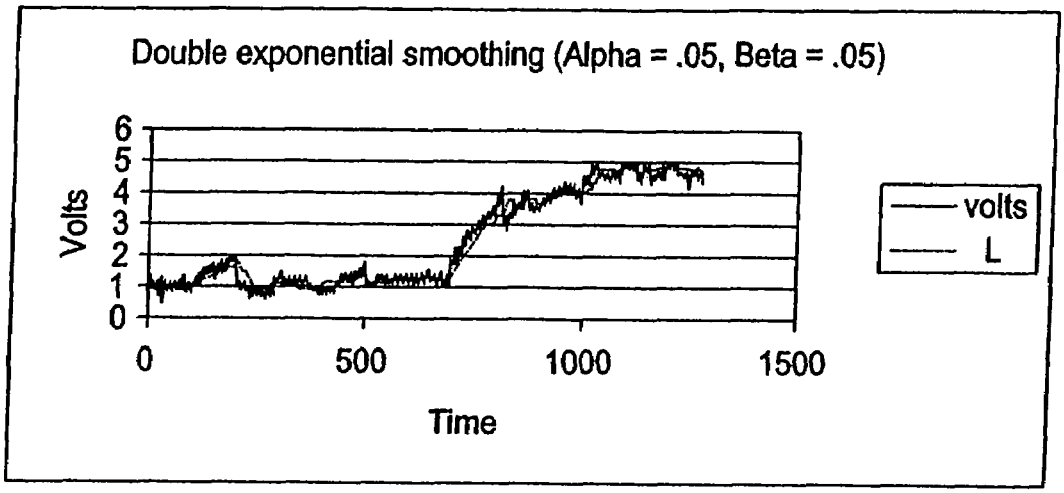
Figure 10:
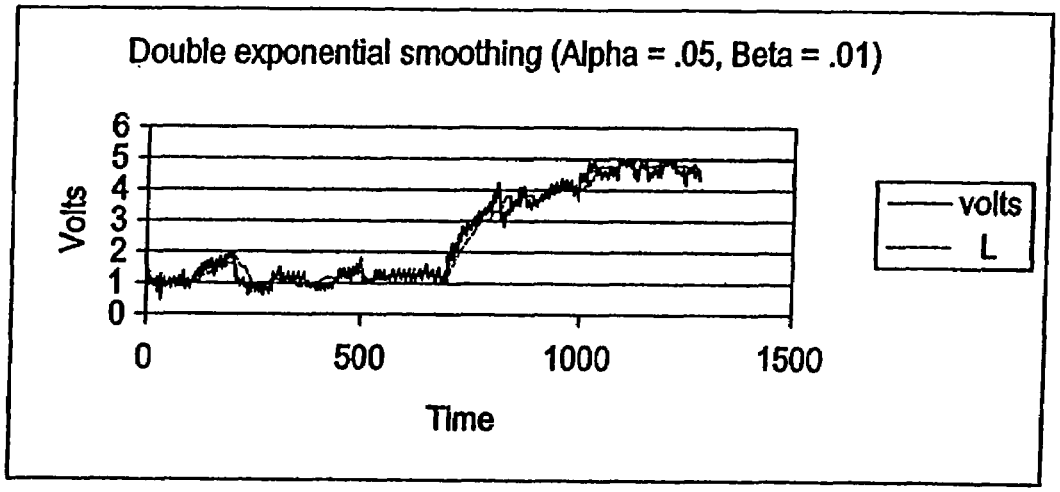
Figure 11:
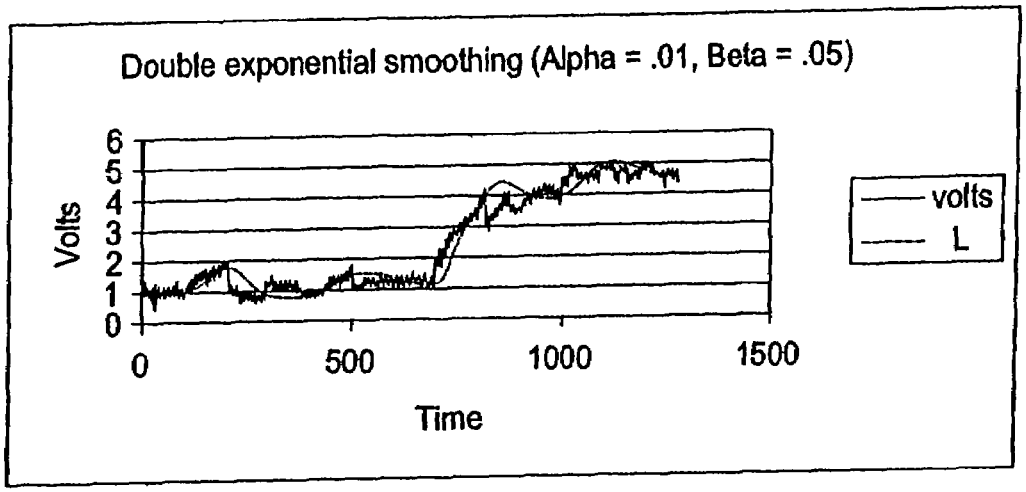
Figure 12:
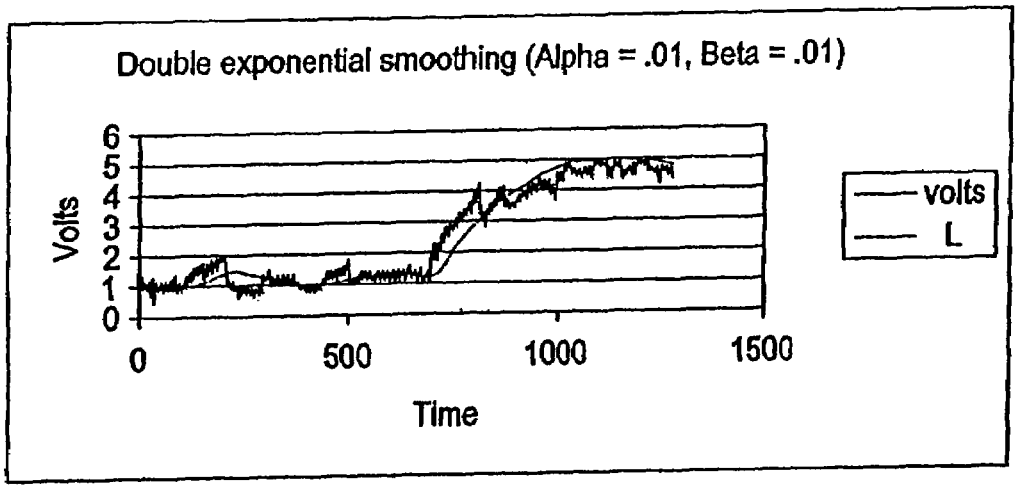

FIG. 7 is a plot of an exemplary raw signal from the moisture sensor, which signal is indicative of moisture content in the articles being dried. As shown in FIG. 7, the voltage level changes during the drying cycle and the slope, that is, the rate of change of the voltage signal also changes during the drying cycle. By way of example, the voltage signal may be low and the slope may be flat early in the cycle when the clothes are wet. Then the voltage and slope may increase in the middle of the cycle when the clothes are becoming dryer. Finally, the voltage may be high, i.e., approximately five volts, and the slope becomes flat once again when the clothes are substantially dried. FIGS. 8 through 12 illustrate respective plots of smoothed signals. More particularly FIG. 8 illustrates just the smoothed signal. FIGS. 9 through 12 include the raw signal along with smoothed signal. Each plot illustrates exemplary smoothed curves for different combinations of smoothing parameters alpha and beta.

Figure 13:
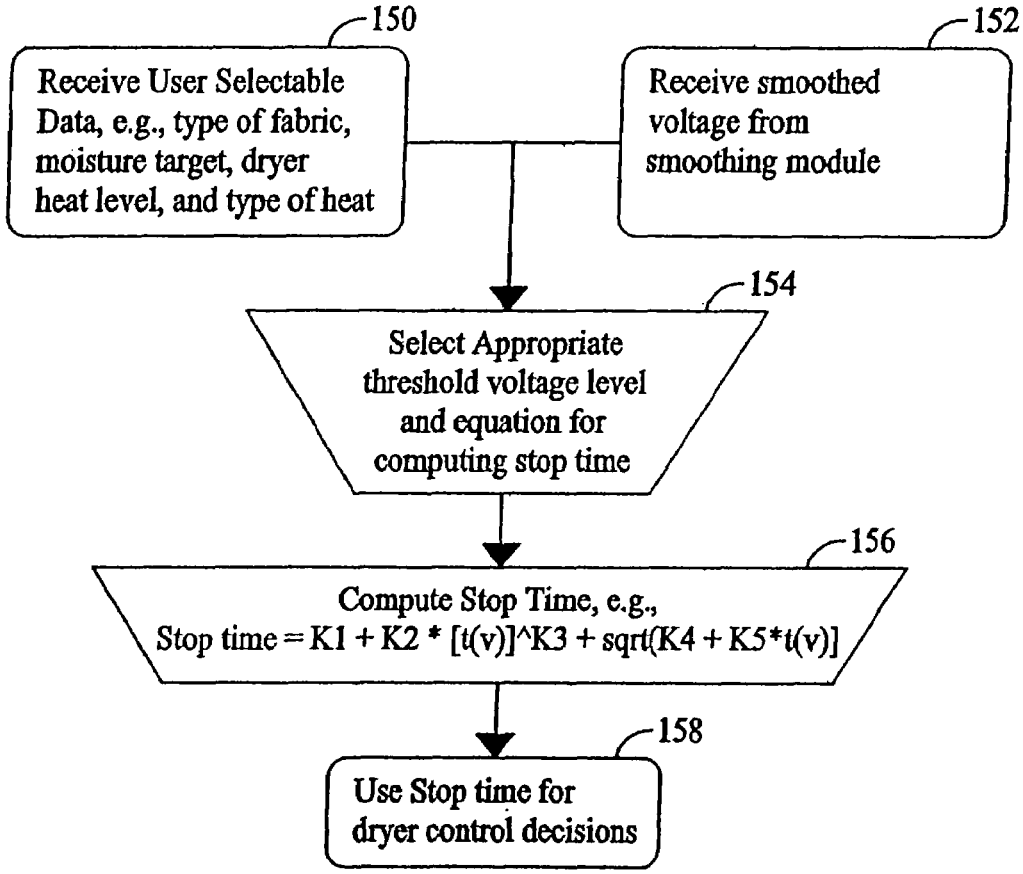
FIG. 13 is an exemplary flow chart for estimating dry-cycle stop time as the cycle is being executed.

FIG. 13 illustrates exemplary steps executed in processor module 108 (FIG. 3) for controllably stopping a clothes dryer when a specified moisture level of the clothes is achieved, based on the voltage signal from the moisture sensor and/or elapsed time. As suggested above, the voltage signal from moisture sensor 52 (FIGS. 1 and 2) in a clothes dryer provides an estimate of the moisture level in the clothes dryer. However, the relationship between moisture content in the articles and sensor voltage is not the same for all fabric types. Thus, the control strategy of the present invention may take different forms depending on a plurality of various parameters that may influence duration of a given dry cycle. Example of such parameters may include the type of clothes fabric, the target moisture level, the dryer heat level, the load size, the type of heat source (electric or gas), etc. As shown in step 150, processor module 108 receives user-selectable data as well as data that may be preprogrammed for a specific dryer appliance based on its specific design characteristics. An exemplary form of an algorithm that may be executed in processor module 108 may be generically represented as follows:

Let $t(v)$=the time to reach a certain voltage level, $v$, then

Stop time=$K1+K2*[t(v)]\hat{}K3+\mathrm{sqrt}(K4+K5*t(v))$

Where v and K1 through K5 are experimentally and/or analytically derived constants that, for example, may vary based on the fabric, moisture target, dryer heat level, and type of heat source. It will be appreciated that the present invention is not limited to the exemplary algorithm illustrated above being that other functional relationships, such as logarithmic relationships and even more computationally complex relationships, could be used in the algorithm for estimating the stop time.

Processor module 108 further allows for providing respective minimum and maximum time limits for stopping the dryer based on experimentally and/or analytically derived data for respective categories of loads under various conditions. For example, these time limits may represent operational constraints of the sensor at both the low and the high end of its output signals. Just like the control strategy for determining or estimating the stop time for a given load, the lime limits may be uniquely assigned to each combination of cycle selection and heat level programmed by the user at the start of a respective cycle.

As suggested above, the level of the voltage signal supplied by moisture sensor 52 is related to the moisture content of the clothes. For example, at the beginning of the cycle when the clothes are substantially wet, the voltage level from the moisture sensor may range between about one or two volts and the slope may be relatively flat. As the clothes become dryer during execution of the cycle, the voltage level awl slope of the signal from moisture sensor 52 increase. Finally, the voltage level may reach an upper limit, e.g., approximately five volts, and the slope once again becomes relatively flat when the clothes are substantially dried. The foregoing characteristics of the signal from the moisture sensor may be used by processor module 108 for detecting various situations where the dryer should be stopped such as: whether the clothes are substantially dry, e.g., less than two percent moisture content; whether the dryer is being operated without any clothes in it; whether failures have occurred in the sensor circuitry and/or wiring. In either situation, the level of the voltage signal from the moisture sensor may reach a region of relatively little or no response, that is, a region where there are virtually no further changes. The following actions may be iteratively executed by the processor module to stop operation of the dryer based on the lack of voltage level variation in the signal supplied by the moisture sensor. By way of example, the standard deviation of a predetermined number of data samples (e.g., 90 data samples) of the moisture sensor signal, such as may be sampled at the rate of one data point per second, may be calculated and then compared against a predetermined standard deviation threshold value. If the calculated value is less than the standard deviation threshold value, this could indicate that the clothes are fully or virtually dry. It could further indicate that there are no clothes in the dryer, or a possible malfunction. In either case, the dryer would be stopped. If the value of the calculated standard deviation is more than the threshold standard deviation value, then a new set of additional data samples of the signal form the moisture sensor would be recorded and compared with the threshold again. This sequence could be repeated until either the standard deviation is less than the threshold standard deviation value, or the level of the voltage signal reaches a threshold voltage level, as described in the context of FIG. 13, or the maximum time for the respective dry-cycle is reached. Thus, it will be appreciated that may be at least three distinct techniques by which the dry cycle can be stopped when using the moisture sensor: the threshold voltage level technique referred to above; the voltage signal variation using the standard deviation processing technique described above, such as may be used for safeguarding or backing-up the threshold voltage level technique in case the signal level does not reach the threshold voltage level due to hardware malfunctions, such as capacitor leakage, or in the event the dryer does not have any clothes in its drying drum; or by measuring whether the elapsed time has reached a respective maximum time for the cycle being executed.

As described above, the sensor output voltage signal may be sampled at a predetermined rate, e.g., one Hz, during the dryer cycle, to be smoothed in smoothing module 106 to generate a new smoothed series. As shown in steps 152, 154 and 156, the smoothed samples of the moisture signal indication received by processor module 108, are executed following an appropriate control strategy for a respective combination of fabric, moisture target, dryer heat level, and type of heat source to determine the appropriate time to stop the dryer. Step 158 allows for using the computed stop time for executing dryer control decisions, such as whether to commence a tumble cycle, terminate operations of the dryer appliance, etc.

In operation, processor module 108 allows for stopping the clothes dryer when the clothes, regardless of their specific characteristics, such as load size, fabric type, etc., have statistically and probabilistically achieved the target moisture level selected by the user at the start of the cycle. It is believed that this capability will greatly satisfy the needs of consumers since their clothes will be controllably dried using stop times consistent with the selection of the user at the outset of the cycle and further based on the actual characteristics of the clothes. Further, such capability is believed to conserve time and energy by not over-drying the clothes.

As suggested above, many factors could potentially affect the relationship between the voltage of the moisture sensor and the actual moisture content of the clothes. Examples of some of these factors are:

Clothes type (cotton, permanent press, delicate, etc.)
Room temperature
Room humidity
Initial moisture content (IMC) of the clothes
Restriction of the exhaust duct, which affects air flow
Dryer heat level (high, medium, low, gentle)
Load size (weight)
Time duration of the drying cycle
Type of heat source (electric or gas)

It will be appreciated by those skilled in the art that any selected control strategy for predicting stop time while executing a drying cycle will be most useful if it reliably and accurately works for a wide range of operational conditions encompassing at least the exemplary factors given above. For example, if a predetermined known variable affects the relationship between the sensor output signal and the moisture content level of the articles, then it would be valuable to have a control strategy that accounts for deviations introduced for each level of that variable for estimating the relationship between the sensor output signal and the moisture content of the articles.

FIGS. 14 through 18 shows respective graphs illustrating several exemplary control strategies embodied in processor module 108. As suggested above, since it is desirable that any given control strategy works well under a variety of usage conditions, then the efficacy of any given control strategy executed in module 108 was statistically and probabilistically demonstrated through collection and analysis of experimental data from multiple test runs exemplifying a variety of conditions of the above-mentioned variables.

While conducting such test runs, by way of example, the clothes were weighed when dry, that is, before getting them wet for the drying experiments, and then weighed again after they were wet and before they were placed in the dryer. These two respective values were used to compute the initial moisture content (IMC) of the clothes before drying. The dryer was placed on a scale to get continuous readings of weight over time. The change in weight over time was used to estimate the weight of moisture that was lost, and then this change was converted to the moisture reduction over time, e.g., a percentage of moisture reduction, in the load as the drying cycle was executed. These values were checked at the end of the cycle by measuring the final weight of the clothes.

The test equipment set up also collected raw sample measurements of the voltage signal from the moisture sensor at a predetermined rate, e.g., one Hz. The raw voltage signal of the sensor was smoothed with an exemplary double exponential smoothing algorithm, described in the context of FIG. 6. A smoothed signal is helpful to develop a statistically meaningful relationship between the voltage of the rods and the moisture content of the clothes. The data collected in this manner was used to determine the time required to achieve a certain moisture level and the time required to achieve a certain voltage level in the sensor signal. The two times were then compared to determine the voltage level to stop the dryer to achieve the desired moisture level.

FIGS. 14 through 18 show respective plots of experimentally and/or analytically derived data used for developing the various control strategies implemented in processor module 108. The data plots of FIG. 14 through 18 used an exemplary electric dryer, tested under a variety of conditions of the various variables capable of influencing duration of a drying cycle.

Figure 14:
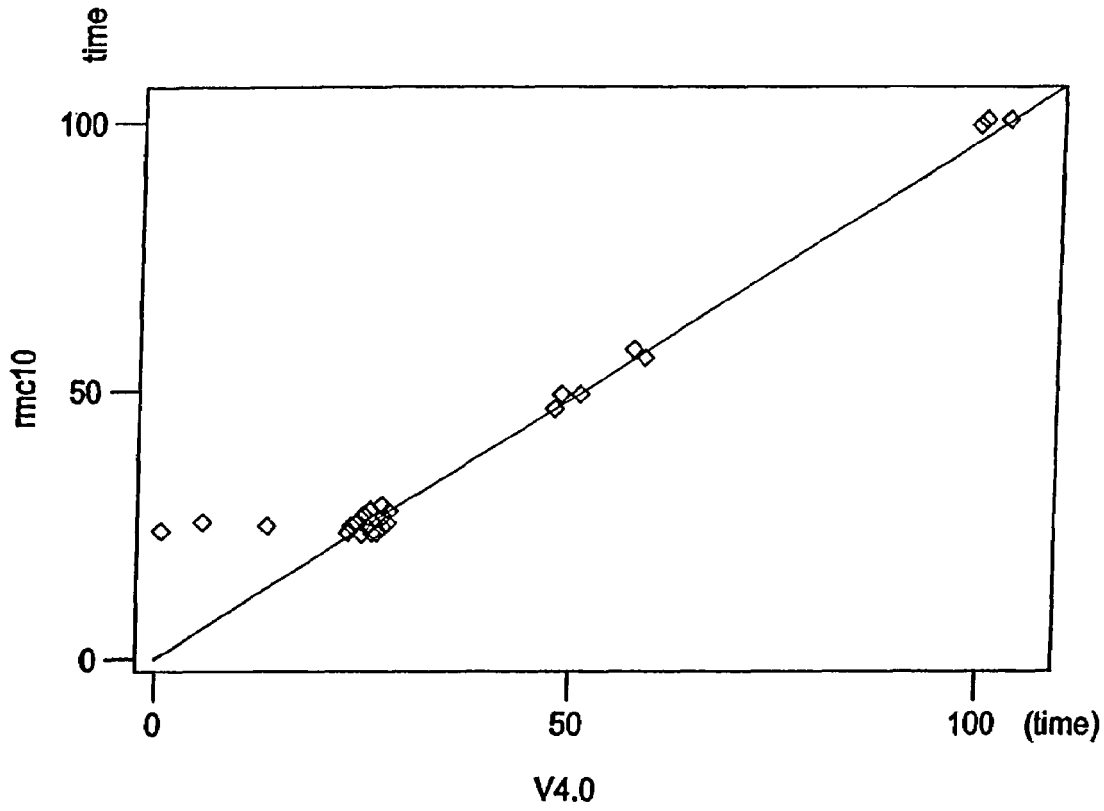
FIGS. 14 through 18 show respective exemplary plots of experimentally and/or analytically derived data used for developing functional relationships for statistically estimating the dry-cycle stop time most appropriate based on characteristics of the articles being dried and dry-cycle parameters selected by the user.
Figure 15:
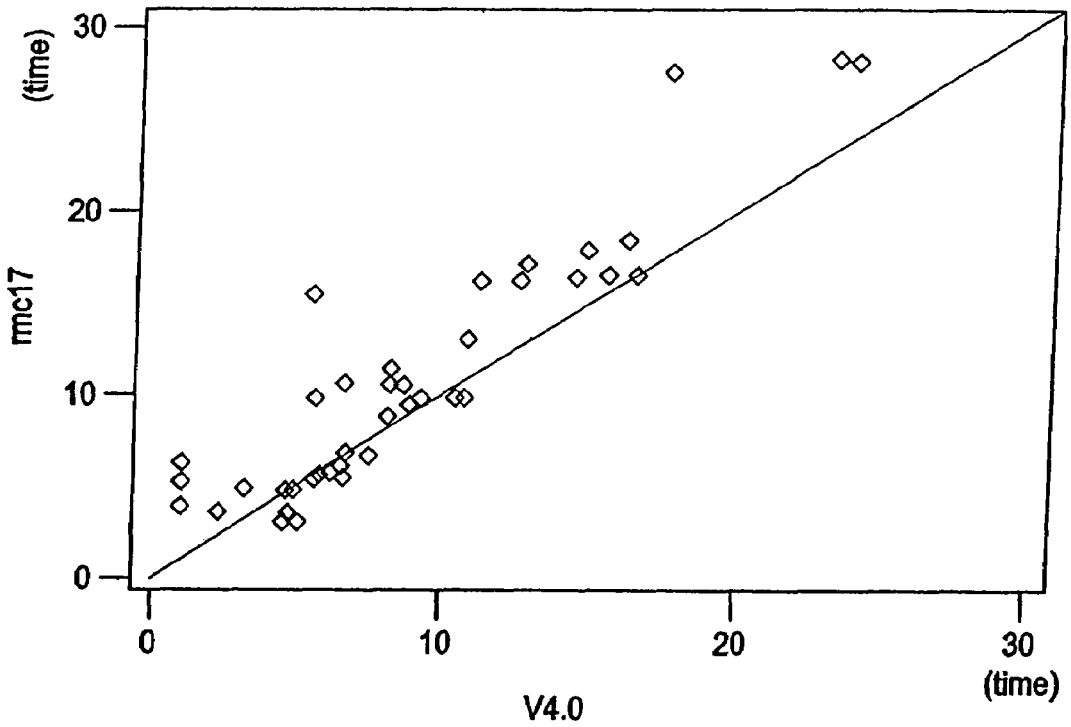

FIG. 14 shows au exemplary illustration of the relationship between the voltage of the moisture sensor and the moisture level of cotton loads. The horizontal axis in the graph represents elapsed time (minutes) until the moisture sensor signal reached 4.0 volts. The vertical axis is the time (minutes) until the moisture level reached 10%. The diagonal line in the graph is the line of equality, where each of the foregoing times is equal to one another. From FIG. 14, it should be appreciated that for cotton loads that required greater than about 25 minutes, the time to reach a voltage level of 4.0 volts and the lime to reach a 10% level of moisture are nearly equal. Thus, the time elapsed to reach 4.0 volts is a good predictor of the time to stop the dryer in order to achieve a 10% final moisture content, provided the elapsed time is about 25 minutes or greater. It will be further appreciated from FIG. 14, that the foregoing pattern does not hold for cotton loads that required relative short times, e.g., 20 minutes or less. These low times are typically associated with small loads of clothes. Thus, a suitable control strategy for cotton loads would dictate that the minimum drying time should be at least 20 minutes, even for small clothes loads. The above strategy recognizes that it takes some minimum time to heat the dryer to initial conditions, and further recognizes that the heat transfer and evaporation are not as efficient for small clothes loads.

Figure 16:
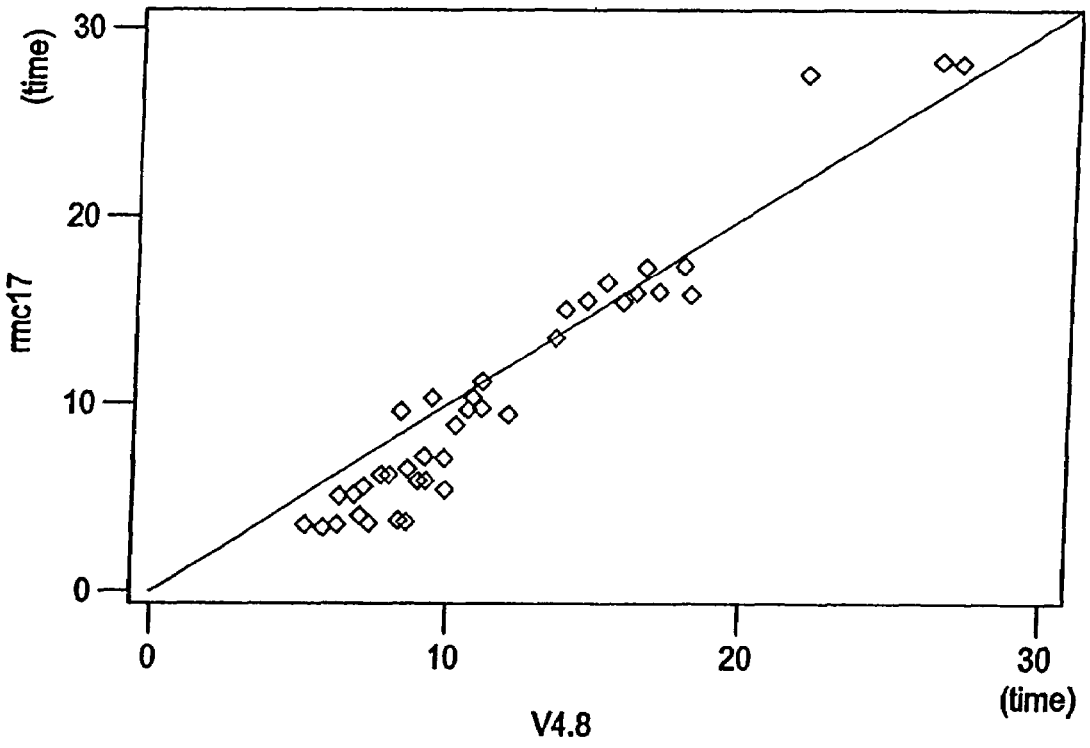

As suggested above, the relationship between the voltage of the moisture sensor and moisture level would be different for delicate loads, and thus the control strategy for selecting the dryer stop time for delicate loads would be different than the strategy for cotton loads and other types of loads. Similar to FIG. 14, in FIG. 15 the horizontal axis in the graph represents elapsed time (minutes) until the moisture sensor signal reached 4.0 volts. The vertical axis is the time (minutes) until the moisture level reached 17%. The diagonal line in the graph is the line of equality, where each of the foregoing times is equal to one another. From FIG. 15 it will be appreciated that if the dry time is relatively short, e.g., less than about 10 minutes, then the time that it takes the moisture sensor signal to reach a voltage level of 4.0 volts would be the correct time to stop the dryer. Conversely, and as seen in FIG. 16, if the dry time is relatively long, e.g., more than about 10 minutes, then the time that it takes the moisture sensor to reach about 4.8 volts would be the correct time to stop. This means that if the correct target moisture level is to be achieved for delicate loads, then the stop time should be a function of both the elapsed timed time as well as the voltage level from the moisture sensor. Thus, the control strategy for delicate loads determines stop time as a function of voltage and time. Such control strategy may be mathematically represented by the following exemplary equations:

For 17% Moisture:

Minimum time=3.5 minutes.

If moisture sensor signal (v(t)) is greater than 4.3 volts at 3.5 minutes, then stop.

Stop between 3.5 and 12 minutes if: v(t)>L+L1*elapsed time.

Stop after 12 minutes when v reach 4.8, where L and L1 are experimentally and/or analytically derived constants.

It will be appreciated that the foregoing control strategy may not be readily executable with an electromechanical control system, however, such control strategy can be handled well with a microprocessor control system, such as controller 58.

For some loads, a moisture content of about 17% may not be reached until the voltage of the moisture sensor reaches a relatively high threshold voltage, such as 4.8 volts, that is, until the voltage level is near the upper voltage limit of the moisture sensor. For example, if the goal is to dry a delicate load to a moisture level below 17%, then stopping when the threshold voltage is reached may not provide a highly accurate stop time since the highest possible voltage is about 5.0 volts. Consequently, it would be difficult to reliably detect small differences between 4.8 and 5.0 volts.

Figure 17:
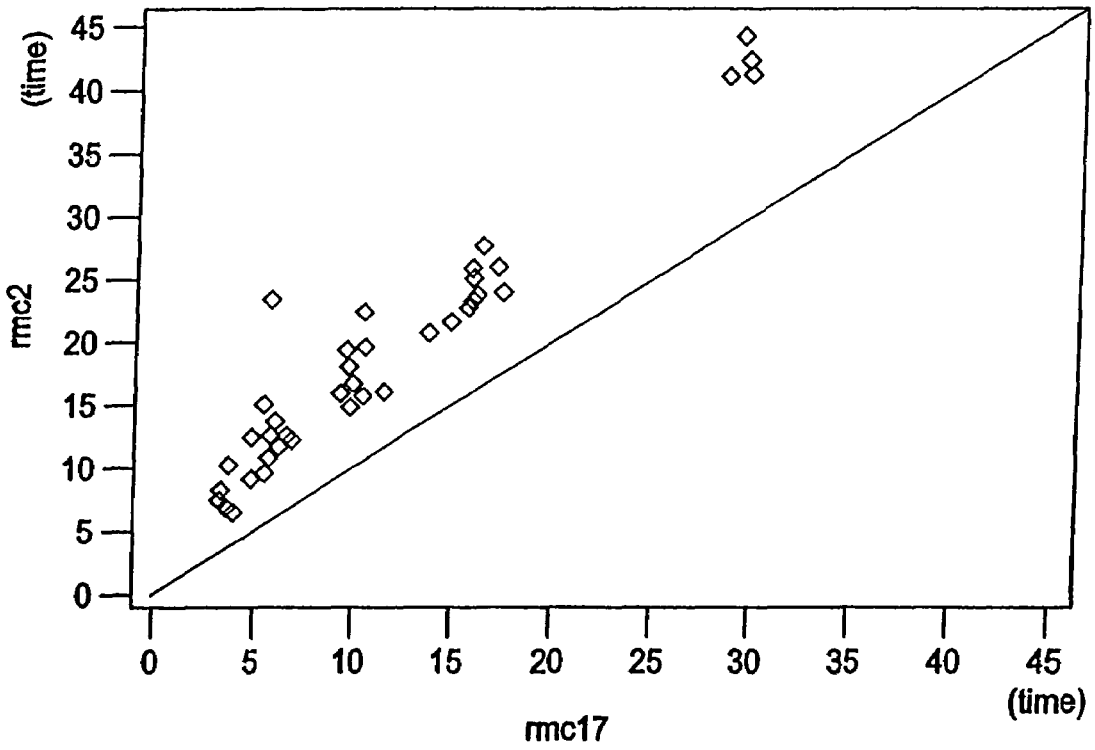

As illustrated in FIG. 17, an exemplary control strategy that may be used where the threshold voltage level of the moisture sensor is close to its upper range, that is, in a region where the sensor signal response is relatively flat to further changes in moisture content, and the desired target moisture content is, for example, below a predetermined percentage, such as about 17%, would be to first record the time elapsed to reach the 17% moisture content, and then add a percentage of that time to obtain the desired moisture target. For example, if the target moisture ratio is 2%, a mathematical relation can be derived for the ratio of time elapsed to reach 2% moisture over time elapsed to reach 17% moisture, and then this ratio can be factored to achieve the desired moisture level of 2% or any other moisture value below 17%.

An exemplary relation used in the context of delicate loads may be as follows:

For Moisture Values Less than 17%:

stop time=10^$a$*(time to RMC=17%)^(1−$b$)

where:

a=M1−M2*(RMC target)+M3*(RMC target)^2 b=M4−M5*(RMC target)

wherein RMC represents the target moisture content, a, b, and M1 through M5 represent experimentally and/or analytically derived constants.

Figure 18:
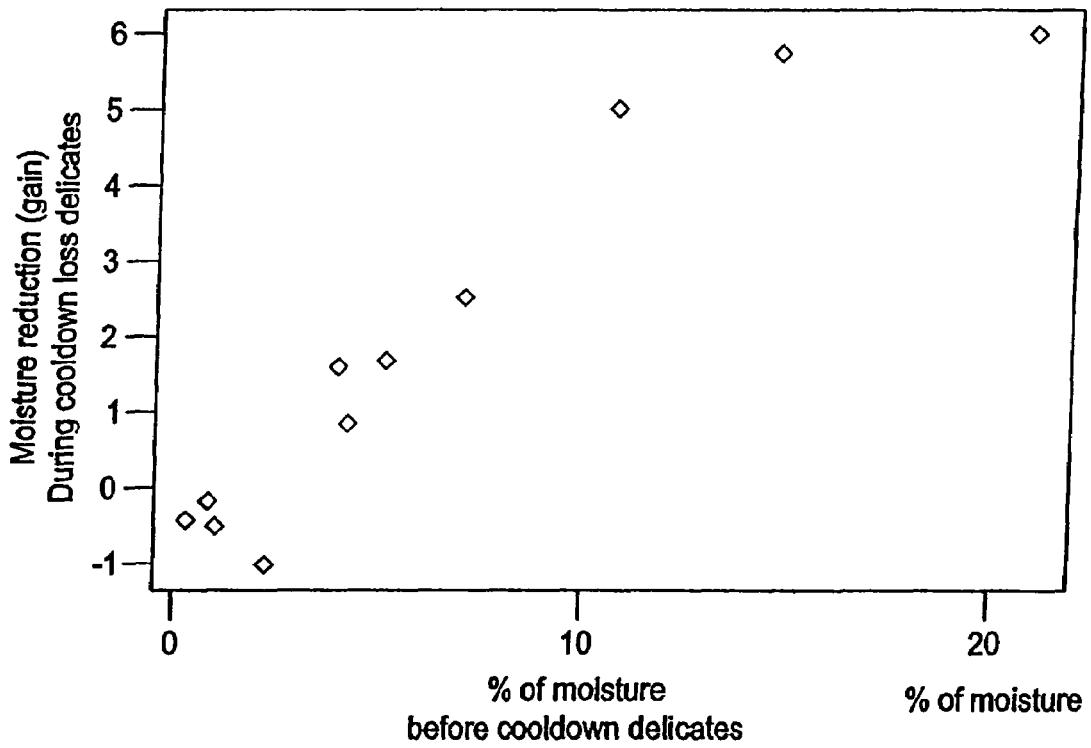

As will be appreciated by those skilled in the art, there may be a period at the end of the drying cycle where the clothes may continue to tumble without any heat input from the dryer heaters. As shown in FIG. 18, depending on the level of moisture at the end of drying cycle, the clothes often continue to lose moisture during cool down. Processor module 108 is further configured to estimate the moisture loss that may occur during cool down for various fabrics and moisture levels at the start of cool down. This suggests that the heating cycle should be terminated when the moisture level is at a predetermined amount above the final moisture target, so that the desired final moisture level is obtained after execution of the cooling portion of the cycle. It will be appreciated from FIG. 18 that if the moisture level is relatively low, e.g., below about 1% before cool down, then the clothes may increase in moisture during cool down. In either case, the moisture change during cool down is also accounted in processor module 108 that determines the stop time of the dryer.

Figure 19:
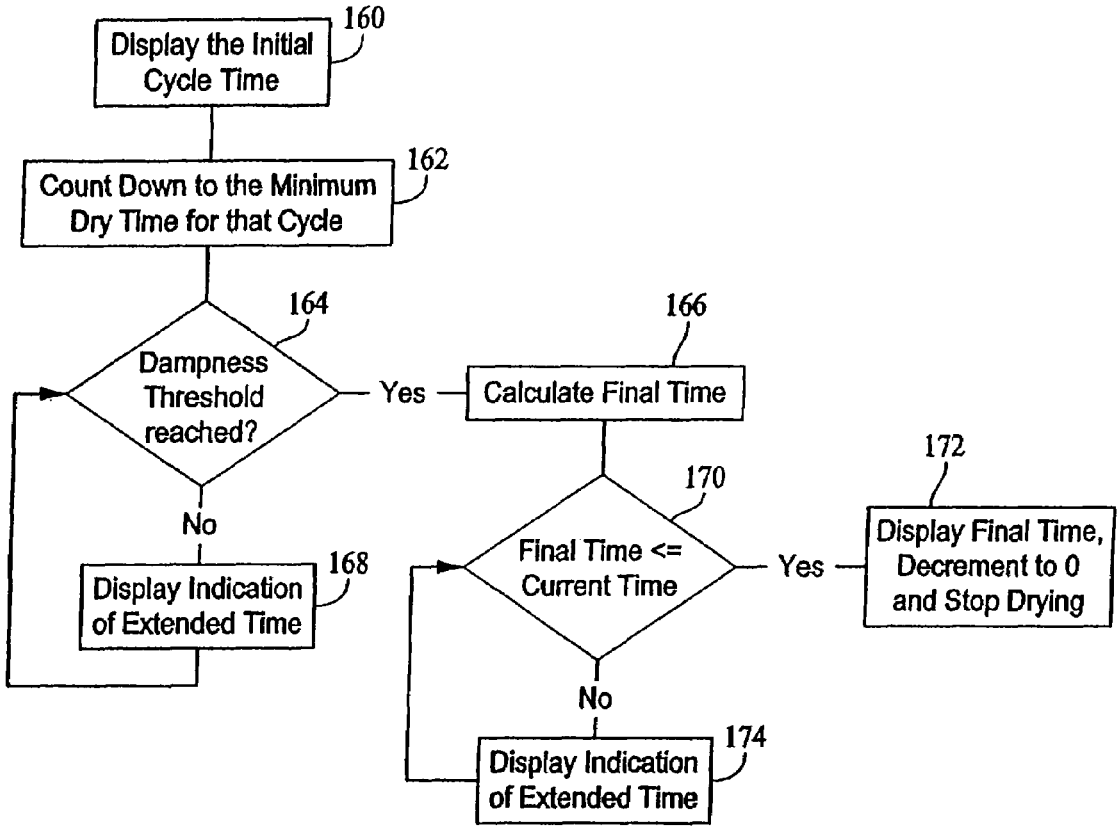
FIG. 19 is an exemplary flow chart for updating the dry-cycle stop time as the cycle is being executed.

In one exemplary embodiment the dryer will have a multi-digit display 222 (FIG. 20), such as a two-digit display which will display respective initial estimates of the time for completing a respective drying cycle. Display 222 may further count down to show remaining time for completing the respective cycle. As suggested above, the initial estimates of cycle time may vary substantially from one run to another run based on the various factors discussed above, such as load characteristics, dryer installation, etc. To account for such potential variability, and adjust the displayed time as the cycle is being executed CPU 66 may implement the exemplary steps shown in the flow chan of FIG. 19. Step 160 allows for displaying at the start of a respective cycle an initial estimate of the time for completing the cycle to a desired dryness level. For example, such initial estimate may be based on the historical data processed by estimating module 102 (FIG. 3). A step 162 allows for counting down or decrementing the initial time estimate until a minimum time to complete that cycle has been reached. As suggested above, the minimum time will vary depending on the specific cycle selections and heat settings made by the user at the outset of the dry cycle.

A step 164 allows for determining whether a respective voltage dampness threshold has been reached. The dampness threshold may be selected by processor module 108 (FIG. 3) based on the processing of the smoothed moisture sensor signal and the elapsed time signal. As suggested above, the respective dampness threshold is determined in processor module 108 to be consistent with the physical characteristics of the load being dried as well as the target dryness and heat setting selection made by the user. If the respective dampness threshold has been reached, step 164 allows for calculating a final estimation of the dry time cycle. For example, assuming an easy-care load, and further assuming that the threshold dampness is 5% moisture content and the desired target dryness is 2%, then upon step 164 determining that the 15% threshold has been reached, then step 166 allows for calculating a final estimation of the time which will be needed for reaching the desired 2% target dryness. If the dampness threshold has not been reached, then step 168 allows for displaying a visual indication that a computation of the final time estimate has not being executed and a time extension relative to the presently displayed time estimate will be needed.

The visual indication may take different forms or patterns, such as a simulated "race track" pattern having an outer perimeter selectively lighted to give the illusion of a race as the drying cycle continues to be executed. Further refinements may include controlling the race track pattern to display simulated motion at a rate that varies proportional to the approximate remaining time. For example, a slower rate as the finishing goal is getting closer. In one exemplary embodiment, the rate may be respectively adjusted as each of a respective plurality of voltage ranges is successively reached as the dry cycle is being executed. For example, assuming that the minimum dry-cycle time for executing a respective cycle is 30 minutes, and further assuming that the threshold voltage for reaching the desired level of dryness for that cycle is 4.5 volts, and that the level of the sensor signal sensed at 30 minutes is 3.5 volts, then one could compute the difference between the threshold voltage and the voltage level sensed at the minimum dry-cycle time and divide that voltage difference by an integer number n, e.g., the number four, to generate n distinct voltage ranges at which the rate could be adjusted. In this example, the difference between the threshold voltage and the voltage level sensed at the minimum dry-cycle is one volt and using the exemplary value of integer n being equal to four, then each respective voltage range would be successively incremented by one-quarter of a volt (one volt divided by the number four) to define four distinct ranges for selecting a respective distinct slower rate for each respective one of the four ranges. Thus, in a first voltage range from about 3.5 to about 3.75 volts, the rate of simulated motion would be set at a relatively fastest rate, in a second voltage range from about 3.75 volts to about 4 volts the rate of simulated motion would be set at the next slower rate, in a third voltage range from about 4 to about 4.25 volts the rate of simulated motion would be set at a slower rate relative to the rate in the second of voltage range, and in a fourth voltage range from about 4.25 to about 4.5 volts the rate of simulated motion would be set at the slowest rate relative to the other three voltage ranges. It will be appreciated that the present invention need not be limited to selectively setting a slower rate as the finishing goal is getting closer being that one could selectively set a faster rate as the finishing goal is getting closer. Similarly, the number of voltage ranges for setting the rate of simulated motion need not be limited to four and further the respective voltage ranges need not be of equal size.

Another alternative in lieu of a simulated race track would be to display the last displayed time and start flashing an LED display which may read words, such as "EXTENDED TIME" or "AWAITING MODE" or other similar words communicating to the user that a time extension is needed in order to be able to estimate the time required to complete the respective dry cycle. The foregoing visual indication will continue until in step 164 it is eventually determined that the dampness threshold has been reached. Stop 170 allows for determining whether the calculated final time estimate is less than or equal to the last displayed time. If the calculated final time estimate is in fact less than or equal than the last displayed time, then step 172 allows for displaying the calculated fin time estimate and continue to decrement the display until the time remaining indication reads zero, at which time the drying cycle will be terminated. Conversely, if the calculated final time estimate is greater than the last displayed time, then step 174 allows for displaying the awaiting visual indication, such as the simulated race track display referred to above. This feature would allow for displaying to the user a relatively continuous time-remaining indication and thus avoiding gaps or jumps in the time-remaining indication, which could create contusion to the user.

Figure 20:
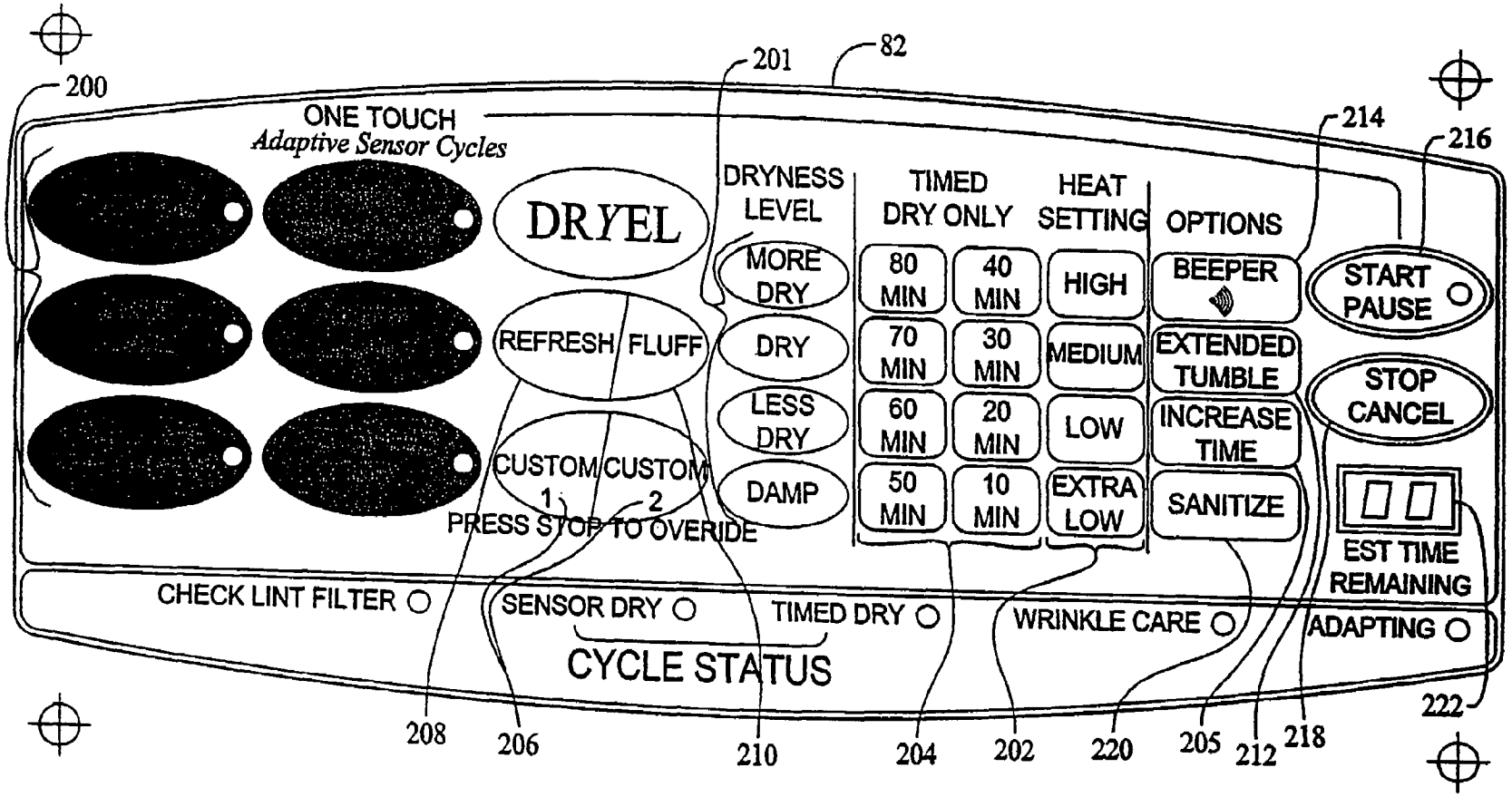
FIG. 20 schematically shows an exemplary interface panel for controlling operation of the dryer including a multi-digit display for displaying stop time related data.

FIG. 20 illustrates an exemplary embodiment of interface and display panel 82. As shown in FIG. 20, interface and display panel 82 comprises a plurality of sensor-mode dry cycle buttons 200, that is, buttons that when actuated by the user will supply data to controller 58 in order to select an appropriate control strategy for determining the stop time of a drying cycle based on moisture sensor data and elapsed time. When one of the sensor-mode dry cycle buttons is selected, a predetermined default heat level selection and dryness level will be displayed. The user, however, would be able to change such default settings through respective dryness level buttons 201 and heat setting buttons 202. By way of example and not of limitation, a "damp" level may correspond to a moisture content of about 17%, a "less dry" level may correspond to a dryness level of about 10%, a "dry" level may correspond to about 3% of moisture content and a "more dry" level may correspond to a moisture content of less than about 2%. Further, when the dryer has completed a cycle, and the next selected cycle is the same as the previously executed cycle, then the interface panel will default to the last selected settings for that cycle, assuming the selected settings are not the same as the default settings. Exemplary default settings may be as follows:

Cotton: High heat and Dry

Mixed Loads: High Heat and Dry

Easy care: Medium Heat and Dry

Knits/Sweaters: Low Heat and Dry

Ultra Gentle: Extra low heat and Dry

Speed Dry: High Heat and Dry

By way of example, a speed dry setting provides a high heat cycle targeted for relatively small loads. The speed dry cycle may be selected with other heat settings as may be programmed through heat setting buttons 202.

Interface and Display Panel 82 further comprises a plurality of timed-mode dry cycle buttons 204, that is, each timed dry cycle button provides a respective time selection incrementable, for example, in 10 minute increments in a range comprising 10 to 80 minutes. An exemplary default heat setting for each timed cycle is medium. As suggested above, an increase time button 205 enables the user to add lime in increments of 10 minutes to the displayed time. A custom button 206, made up of two separately operated sections, allows the user to store a presently displayed cycle in memory as a customized cycle for future use. The storage operation may be achieved by holding the respective custom button section for a predetermined amount of time, e.g., about three seconds. A refresh button 208 allows for tumbling the clothes at a high temperature to refresh the clothes and remove wrinkles. A fluff or tumble button 210 allows the user to tumble the clothes for a predetermined amount of time with no heat. An extended tumble button 212 allows for extending the tumble cycle with no heat after drying to reduce wrinkling. A beeper button 214 allows the user for turning on or off the beeper sound at the end of a drying cycle or during the extended tumble cycle. A start button 216 allows for starting the dryer once a respective cycle has been selected or after opening the door of the dryer. A stop/cancel button 218 allows for stopping the dryer or clearing the present selection from the display, assuming a respective cycle has not yet started.

Figure 21:
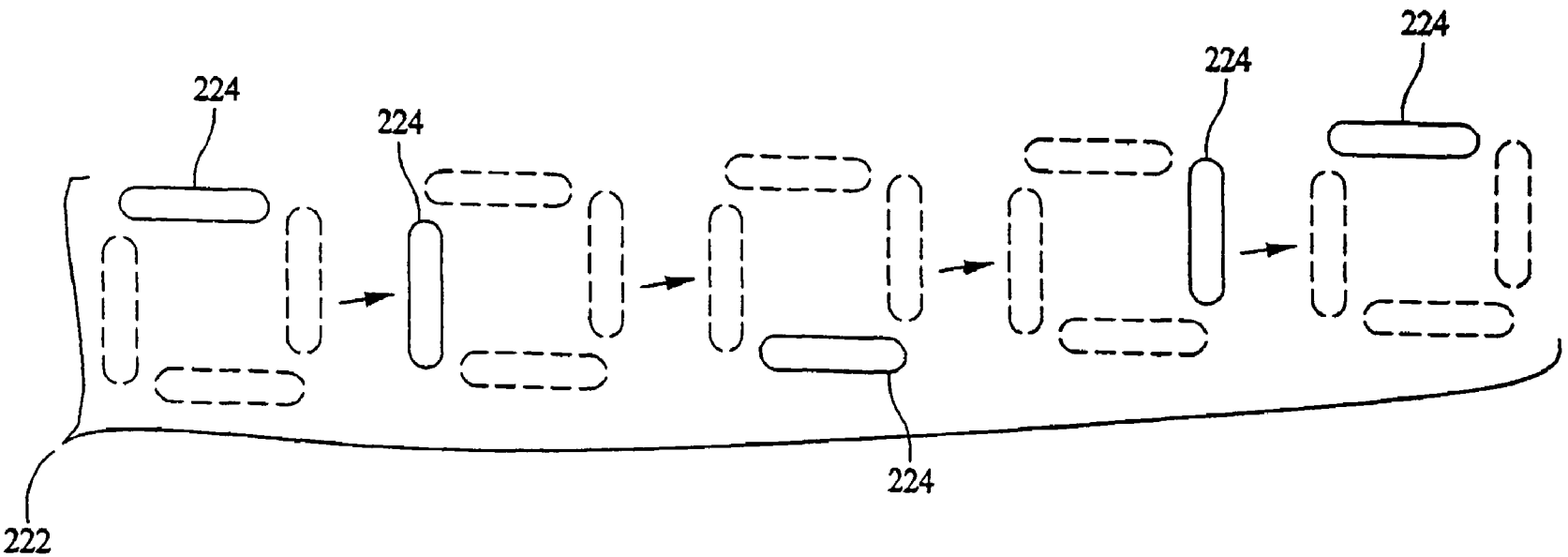
FIG. 21 schematically shows exemplary segments situated at the periphery of the multi-digit display and sequentially illuminated for giving the appearance of movement along the periphery of the multi-digit display to convey a desired lime-dependent visual information to the user.

As shown in FIG. 21, the multi-digit display 222 may comprise a plurality of segments, such as light emitting diode and/or liquid crystal segments, including segments situated at the periphery of the display, such as segment 224. It will be appreciated that if adjacent segments along the periphery of the display are sequentially illuminated at a predetermined rate, such as represented by each segment drawn with a solid line, then this sequential illumination will give the appearance of the "race track" movement along the periphery of the display. As suggested above, it is believed that such movement will visually convey to the user the idea that a time extension is needed in order to be able to estimate the time required to complete the respective dry cycle. If desired, the illumination rate of the adjacent segments may be controlled so that the movement is proportional to the length of time required to complete the cycle, such as a faster rate of movement as the stop time gets closer.

In another advantageous feature of the present invention, and as further described below, a sanitize button 220 (FIG. 20) allows for selecting and executing a sanitize cycle or option upon completion of a dry cycle, that is, upon the articles reaching the desired dryness level.

It is believed that the sanitize cycle provided by the present invention will achieve at least about a 99.9% reduction of the microorganisms that are most likely to exist on a respective clothes load after the load is washed and dried. The sanitize cycle will be achieved without use of separate components by applying heat to the load of articles for a predetermined period of time after the articles have reached a desired level of dryness. As suggested above, sanitation is achieved if a detectable level of microorganisms on samples tested is reduced by a minimum of at least about 99.9%. Some of the microorganisms targeted may include by way of example and not of limitation *staphylococcus, Pseudomnonas aeruginosa*, and *Klebsiella pneumonia.*

In one exemplary implementation, the sanitize cycle may comprise selecting a high heat setting for the dry and the sanitize cycle. As suggested above, the one touch option button 220 (FIG. 20) is provided for activating the sanitize cycle following execution of drying relatively rugged clothes, such as may occur during a cotton or a mixed-load cycle or any other cycle that would be indicative of load clothes targeted to be sanitized. As suggested above, processor module 108 (FIG. 3) allows for determining whether the clothes have reached the desired level of dryness. Assuming the user has activated the sanitize cycle, then upon processor module 108 determining that the desired level of dryness has been reached, then control decision module 110 would command the dryer to commence the sanitize cycle. As suggested above, in the sanitize cycle the dryer is kept running preferably at high heat for a predetermined amount of time that is a function of the length of time determined by processor module 108 to reach the target dryness and thus the length of time required to execute the preceding dry cycle.

In one exemplary embodiment of the present invention, the sanitize option may be selected for cottons, and mixed-loads cycles only. It is envisioned, however, that there may be other cycle selections corresponding to relatively rugged clothes that could be targeted for the sanitize cycle. For other cycles, that is, other than cotton and the mixed-loads, if the user selects the sanitize option, the beeper will provide a fault-indicating beep. Exemplary default settings, such as dryness level, and temperature setting for the sanitize option may be "more dry" and "high" heat.

If the laser has already selected other dryness and temperature settings, that is, other than "more dry" and "high" heat, and the user then selects the sanitize option, and assuming the respective dry cycle selection has been made for cottons, or mixed-loads, then the respective dryness and temperature setting are automatically switched to "more dry" and "high" heat. If after selecting the sanitize option, the user depresses any other dryness, heat or cycle-selection button, then the dryer will be commanded to the selected option and disable the sanitize option.

Generally, if the user selects the sanitize option, this will add a predetermined amount of time, e.g., about 40 minutes for the initial time estimate. As suggested above, the actual sanitize time may vary as a function of the time actually required to complete the dry cycle. The following table is illustrative of exemplary sanitize limes adjusted to account for the actual time taken to complete the dry cycle.

TABLE 2

| cycle time(mins) | sanitize time(mins) |
|---|---|
| 40 or less | add 50 |
| 40 to 50 | add 65 |
| 50 to 60 | add 80 |
| more than 60 | add 99 |

It will be appreciated that the present invention is not limited to the above-illustrated values being that other values could have been chosen to execute the sanitize cycle. It will be appreciated that the remaining-time display will be appropriately adjusted to reflect any additional time required to complete the sanitize cycle. Thus, the user is provided with real-time updates of time-remaining for completing each respective cycle being executed by the dryer.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

We claim:

1. An appliance for drying clothing articles, the appliance comprising:

a container for receiving the clothing articles;

a motor for rotating the container about an axis;

a heater for supplying heated air to the container during a dry cycle;

a sensor for providing a signal indicative of moisture content of the clothing articles;

memory for storing historical stop time data of respective dry cycles;

a noise-redaction filter coupled to receive the signal indicative of moisture content to provide selectable filtering and generate a smoothed signal a timer for providing a signal indicative of elapsed time upon start of the dry cycle;

a module responsive to the historical data in the memory for determining an initial estimate of the stop time of the dry cycle to be executed; and a processor for estimating the stop time of the dry cycle as the cycle is being executed, the estimation of the stop time based on a respective functional relationship of the smoothed signal, anti the timer signal, relative to one or more characteristics of the articles and one or more desired values of predetermined dry-cycle parameters selectable by a respective user of the dryer, the initial estimate of the stop time being superceded by the stop time estimated by the processor as the cycle is being executed.

2. The appliance of claim 1 wherein the module for estimating the initial stop time is configured to execute a moving average of the historical stop time data.

3. The appliance of claim 2 wherein the moving average executed on the historical data is an exponentially-weighted moving average.

4. The appliance of claim 1 further comprising a sub-module for maintaining consistent relationships for each estimated initial stop time regardless of respective characteristics of the articles and desired values of respective dry-cycle parameters selectable by a respective user of the dryer.

5. The appliance of claim 4 wherein the stub-module is configured to execute the following:

constructing a table having a plurality of cells respectively populated with initial stop time estimates corresponding to the respective characteristics of the articles and desired values of the dry-cycle parameters;

selecting one of the plurality of cells as a reference cell;

retrieving the last value of the reference cell;

retrieving an estimated stop time value of the last-executed dry cycle;

retrieving the actual stop time value of the last-executed dry cycle; and calculating a present value of the reference cell based on executing a predetermined moving average on the respective retrieved values.

6. The appliance of claim 5 wherein the submodule is further configured to execute the following: updating each initial stop time estimate in each cell, other than the reference cell, based on a respective weighing ratio relative to the calculated present value of the reference cell.

7. An appliance for drying clothing articles, the appliance comprising:

a container for receiving the clothing articles;

a motor for rotating the container about an axis;

a heater for supplying heated air to the container during a dry cycle;

a sensor for providing a signal indicative of moisture content of the articles; and a filter coupled to receive the signal indicative of moisture content to perform a digital filtering technique to reduce the level of noise in the received signal, the filtering technique configured to detect changes in the level and/or slope of the received signal, wherein the filtering technique is selected from the group consisting of a Holt's linear filtering technique, a median polish filtering technique, a locally-weighted sum of squares filtering technique, a resistant smoothing filtering technique and a spline fit filtering technique, wherein the filter for performing, the Holt's linear filtering technique comprises first and second smoothing constants having respective values selected based on a rate for sampling the moisture-indicative signal.

8. The appliance of claim 7 wherein the respective values of the first and second smoothing constants are further based on the expected noise characteristics of the moisture-indicative signal.

9. An appliance for drying clothing articles, the appliance comprising:

a container for receiving the clothing articles;

a motor for rotating the container about an axis;

a heater for supplying heated air to the container during a dry cycle;

a sensor for providing a signal indicative of moisture content of the articles; and a filter coupled to receive the signal indicative of moisture content to perform a digital filtering technique to reduce the level of noise in the received signal, the filtering technique configured to detect changes in the level and/or slope of the received signal, wherein the filtering technique is selected from the group consisting of a Holt's linear filtering technique, a median polish filtering technique, a locally-weighted sum of squares filtering technique, a resistant smoothing filtering technique and a spline fit filtering technique; and a single exponential smoothing filter having an adjustable smoothing constant having a first value when the level of the moisture-indicative signal being smoothed is increasing and having a second value being smaller relative to the first value when the level of the moisture-indicative signal is decreasing.

10. An appliance for drying clothing articles, the appliance comprising:

a container for receiving the clothing articles;

a motor for rotating the container about an axis; a heater for supplying heated air to the container during a dry cycle;

a sensor for providing a signal indicative of moisture content of the articles;

memory for storing historical stop time data of respective dry cycles;

a timer for providing a signal indicative of elapsed time upon start of the dry cycle;

a module responsive to the historical data in the memory for determining an initial estimate of the stop time of the dry cycle to be executed;

a processor for estimating the stop time of a respective dry cycle as the cycle is being executed, the estimation of the stop time based on a respective functional relationship of the moisture-indicative signal, and the timer signal, relative to one or more characteristics of the articles and one or more desired values of dry-cycle parameters selectable by a respective user of the dryer; and a stop time update module configured to update the estimated initial stop time as the dry cycle is being executed based on the stop time estimation from the processor.

11. The appliance of claim 10 further comprising a display for displaying data related to the stop time estimate for the dry cycle.

12. The appliance of claim 11 wherein the display comprises a light-emitting diode display.

13. The appliance of claim 11 wherein the display comprises a liquid crystal display.

14. The appliance of claim 11 wherein the display in response to respective control signals applied thereto is configured to execute the following:

displaying the initial estimate of the stop time;

counting down to a minimum stop tune for the cycle being executed;

displaying the stop time estimate from the processor upon a respective moisture threshold level being reached; and displaying an await indication in case the threshold level has not being reached.

15. The appliance of claim 14 wherein the display comprises a plurality of segments being selectively lighted in response to the control signals.

16. The appliance of claim 14 wherein the control signals applied to the display are programmed for sequentially illuminating adjacent segments at the periphery of the display at a predetermined rate to give the appearance of movement around the periphery of the display and thus conveying to the user the await indication.

17. The appliance of claim 14 wherein the predetermined rate is chosen proportional to the time remaining for completing the dry cycle being executed.

18. The appliance of claim 11 wherein the stop time update module is configured to update the stop time being presently displayed without substantial time jumps through the use of await indications in case the estimated stop time by the processor is longer relative to the presently displayed stop time.

19. The appliance of claim 18 wherein the display comprises a plurality of segments being selectively lighted in response to control signals applied thereto.

20. The appliance of claim 19 wherein the control signals applied to the display are programmed for sequentially illuminating adjacent segments at the periphery of the display at a predetermined rate to give the appearance of movement around the periphery of the display and thus conveying to the user the await indication.

21. The appliance of claim 20 wherein the predetermined rate is chosen proportional to the time remaining for completing the dry cycle being executed.

22. An appliance for drying clothing articles, the appliance comprising:

a container for receiving the clothing articles;

a motor for rotating the container about an axis;

a heater for supplying heated air to the container during a dry cycle;

a sensor for providing a signal indicative of moisture content of the articles;

a timer for providing a signal indicative of elapsed time upon start of the dry cycle;

a processor for estimating the stop time of a respective dry cycle as the cycle is being executed, the estimation based on a respective functional relationship of the sensor signal, and the timer signal, relative to one or more characteristics of the articles and one or more desired values of predetermined dry-cycle parameters selectable by a respective user of the dryer; and a control decision module coupled to the processor to receive the stop time being estimated therein for controlling the appliance subsequent to the dry cycle, the control decision module being configured for controlling execution of a sanitize cycle subsequent to the dry cycle by energizing the heater to supply heated air at a respective heat level for a respective period of time upon execution of the dry cycle.

23. The appliance of claim 22 wherein the respective period of time for executing the sanitize cycle is selected based on the stop time estimation from the processor.

24. The appliance of claim 23 wherein the respective heat level and period of time is selected to substantially reduce any microorganisms likely to be encountered in the articles upon execution of the dry cycle.

25. The appliance of claim 22 wherein the control decision module is responsive to a single actuation by the user of a sanitize selection key for selecting said sanitize cycle.

26. The appliance of claim 22 wherein the control decision module has a sub-module for preventing selection of the sanitize cycle depending on the article fabric selected by the user.

27. The appliance of claim 26 comprising a stop time update module configured to update the stop time estimation from the processor based on any additional time required for executing the sanitize cycle.

28. The appliance of claim 27 further comprising a display for displaying data related to the stop time estimate for the dry cycle and the sanitize cycle.

* * * * *